US011931630B2

(12) United States Patent
Mizutani et al.

(10) Patent No.: US 11,931,630 B2
(45) Date of Patent: Mar. 19, 2024

(54) GOLF CLUB HEAD

(71) Applicant: Sumitomo Rubber Industries, Ltd., Hyogo (JP)

(72) Inventors: Naruhiro Mizutani, Kobe (JP); Daisuke Kohno, Kobe (JP); Akio Yamamoto, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/929,383

(22) Filed: Sep. 2, 2022

(65) Prior Publication Data

US 2023/0074992 A1 Mar. 9, 2023

(30) Foreign Application Priority Data

Sep. 6, 2021 (JP) ..... 2021-144880

(51) Int. Cl.
*A63B 53/04* (2015.01)

(52) U.S. Cl.
CPC ..... *A63B 53/0433* (2020.08); *A63B 53/0408* (2020.08); *A63B 53/0466* (2013.01)

(58) Field of Classification Search
CPC ..... A63B 60/04; A63B 53/0466; A63B 60/02; A63B 53/0433; A63B 60/52; A63B 2053/0491; A63B 53/04; A63B 53/0408
See application file for complete search history.

(56) References Cited

U.S. PATENT DOCUMENTS

| | | | | |
|---|---|---|---|---|
| 8,257,195 | B1 * | 9/2012 | Erickson | A63B 60/02 473/335 |
| 8,900,070 | B1 * | 12/2014 | Dawson | A63B 60/02 473/335 |
| 9,211,451 | B1 * | 12/2015 | Westrum | A63B 60/42 |
| 9,687,701 | B1 * | 6/2017 | Seluga | A63B 60/00 |
| 9,770,635 | B2 * | 9/2017 | Motokawa | A63B 60/04 |
| 10,874,916 | B2 * | 12/2020 | Willett | A63B 60/00 |
| 11,065,511 | B2 * | 7/2021 | Aramaki | A63B 53/0408 |
| 11,235,208 | B2 * | 2/2022 | Yamamoto | A63B 60/02 |
| 2014/0106903 | A1 * | 4/2014 | Nakamura | A63B 53/0466 473/346 |
| 2015/0065265 | A1 * | 3/2015 | Motokawa | A63B 53/04 473/335 |
| 2016/0023062 | A1 * | 1/2016 | Willett | A63B 60/52 473/329 |
| 2016/0023063 | A1 * | 1/2016 | Willett | A63B 53/0466 29/401.1 |
| 2020/0206586 | A1 | 7/2020 | Yamamoto | |

* cited by examiner

*Primary Examiner* — William M Pierce
(74) *Attorney, Agent, or Firm* — Studebaker & Brackett PC

(57) ABSTRACT

A head includes a face portion, a sole portion, and an internal weight portion provided on an inner surface of the sole portion and located apart from the face portion. The internal weight portion includes a base portion, and a protruding portion protruding from the base portion toward a face side and located apart from the inner surface of the sole portion. The protruding portion is positioned on the face side with respect to the head center of gravity. A thickness of a toe-side part of the protruding portion and/or a thickness of a heel-side part of the protruding portion is greater than a thickness of a middle part of the protruding portion. Alternatively, a middle part of the protruding portion in a toe-heel direction is absent. The internal weight portion may be formed integrally with the sole portion, or may be a different member from the sole portion.

7 Claims, 30 Drawing Sheets

D-D

GOLF CLUB HEAD

CROSS REFERENCE TO RELATED APPLICATION

The present application claims priority to Japanese Patent Application No. 2021-144880 filed on Sep. 6, 2021. The entire contents of this Japanese Patent Application are hereby incorporated by reference.

BACKGROUND

Technical Field

The present disclosure relates to a golf club head.

Description of the Related Art

A golf club head in which a weight portion is provided on an inner surface of a sole portion with a view to lowering the center of gravity has been proposed. JP6645569B1 (US2020/0206586A1) discloses a hollow golf club head in which a weight portion extending along a leading edge is provided on an inner surface of a sole portion.

SUMMARY

The inventors of the present disclosure have found that a new advantageous effect can be obtained by a novel structure relating to a weight portion provided on an inner surface of a sole portion.

The present disclosure provides a golf club head that includes a weight portion having a novel structure that exhibits a new advantageous effect.

In one aspect, a golf club head includes a face portion, a sole portion, and an internal weight portion that is provided on an inner surface of the sole portion and is located apart from the face portion. The internal weight portion includes a base portion, and a protruding portion that protrudes from the base portion toward a face side and that is located apart from the inner surface of the sole portion. The protruding portion is positioned on the face side with respect to a center of gravity of the head. A thickness of a toe-side part of the protruding portion and/or a thickness of a heel-side part of the protruding portion is greater than a thickness of a middle part of the protruding portion, or a middle position of the protruding portion in a toe-heel direction is absent.

DESCRIPTION OF THE PREFERRED EMBODIMENTS

Embodiments of the present disclosure will be described in detail below with reference to the drawings as necessary.

In the present disclosure, a reference state, a reference perpendicular plane, a toe-heel direction, a face-back direction, an up-down direction, and a face center are defined as follows.

Figure 30:
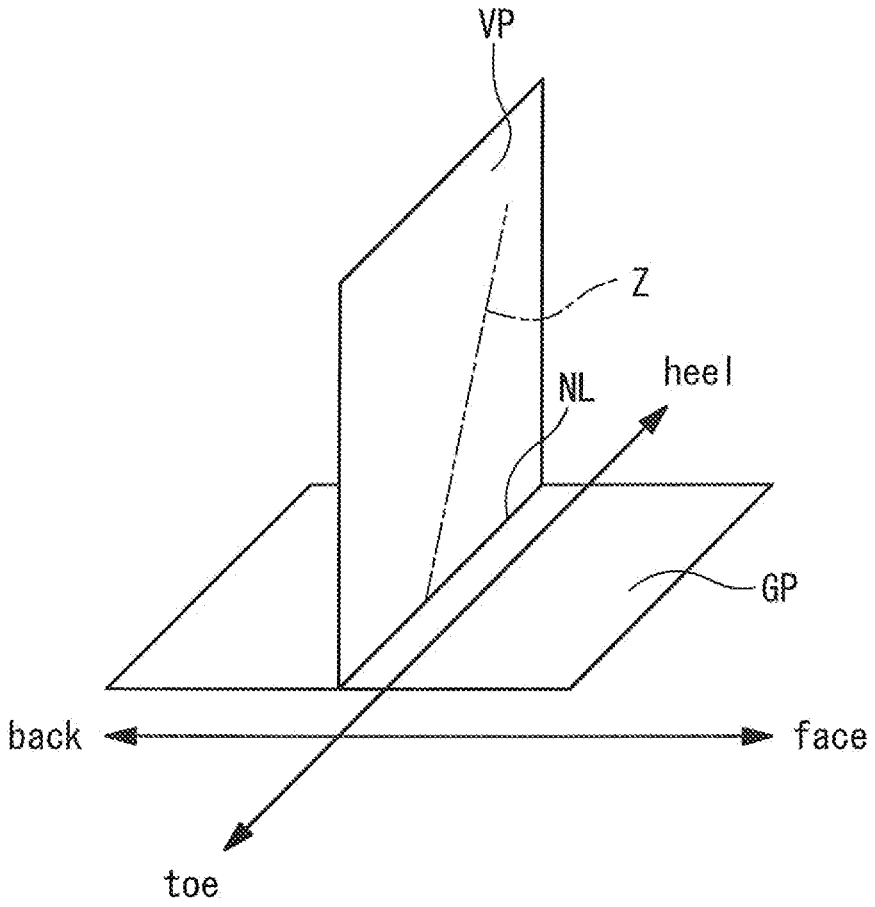
FIG. 30 is a conceptual diagram for illustrating a reference state.

The reference state is a state where a head is placed at a predetermined lie angle on a ground plane GP. As shown in FIG. 30, in this reference state, a shaft axis line Z lies on (is contained in) a plane VP that is perpendicular to the ground plane GP. The shaft axis line Z is the center line of a shaft when the shaft is attached to the head. Typically, the shaft axis line Z is the center line of a hosel hole. The plane VP is referred to as the reference perpendicular plane. The predetermined lie angle is shown in a product catalog, for example.

In the reference state, the orientation of a striking face is set so that a line normal to the striking face at the face center lies on a plane that is perpendicular to the reference perpendicular plane VP and is perpendicular to the ground plane GP. That is, in a planar view of the head as viewed from above, the line normal to the striking face at the face center is set to be perpendicular to the reference perpendicular plane VP.

In the present disclosure, the toe-heel direction is the direction of an intersection line NL between the reference perpendicular plane VP and the ground plane GP (see FIG. 30).

In the present disclosure, the face-back direction is a direction that is perpendicular to the toe-heel direction and is parallel to the ground plane GP.

In the present disclosure, the up-down direction is a direction that is perpendicular to the toe-heel direction and is perpendicular to the face-back direction. In other words, the up-down direction in the present disclosure is a direction perpendicular to the ground plane GP.

In the present disclosure, the face center Fc is determined in the following manner. First, a point Pr is selected roughly at the center of a striking face in the up-down direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the up-down direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the up-down direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center Fc.

First Embodiment

Figure 1:
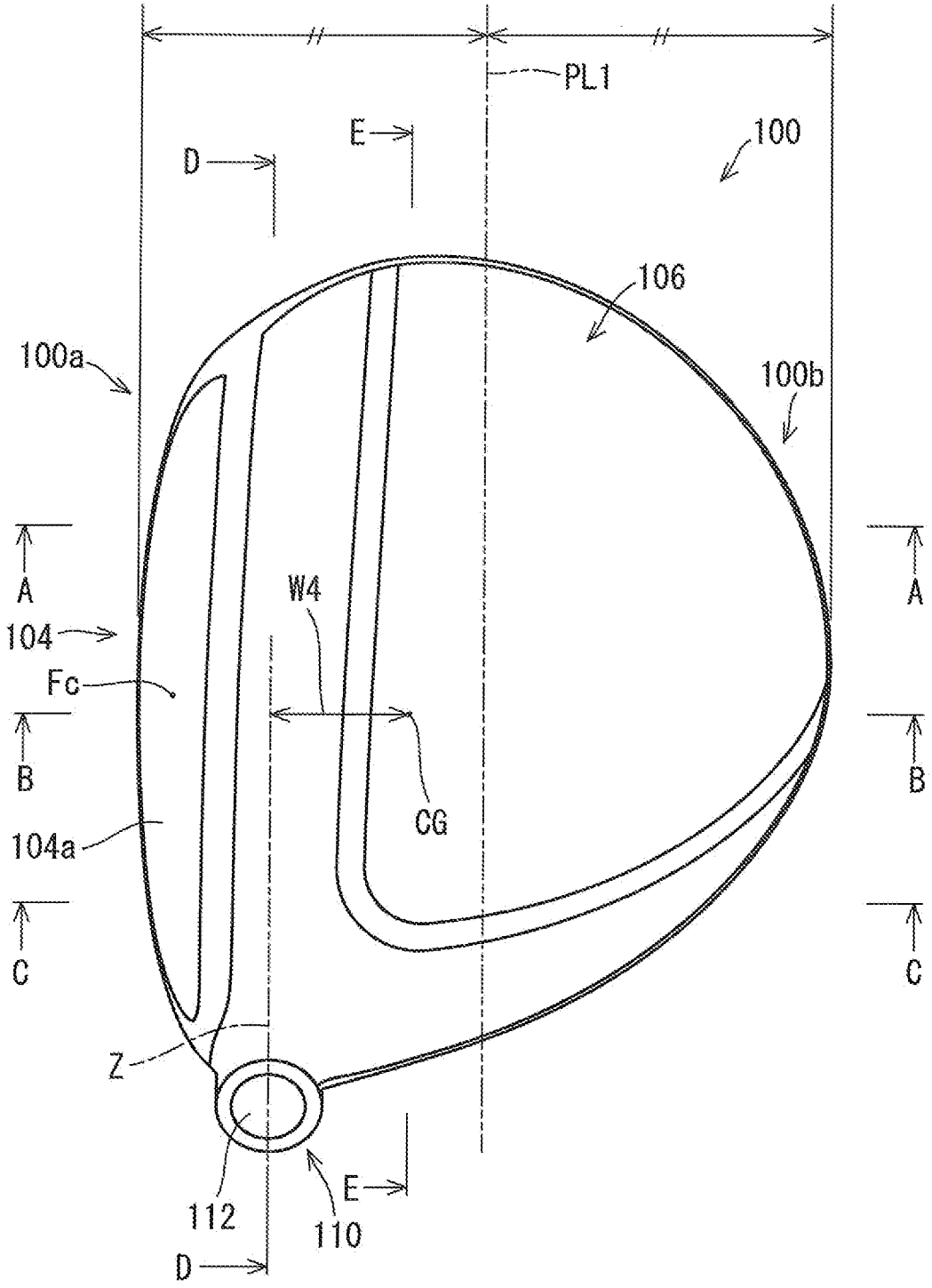
FIG. 1 is a plan view of a golf club head according to a first embodiment.
Figure 2:
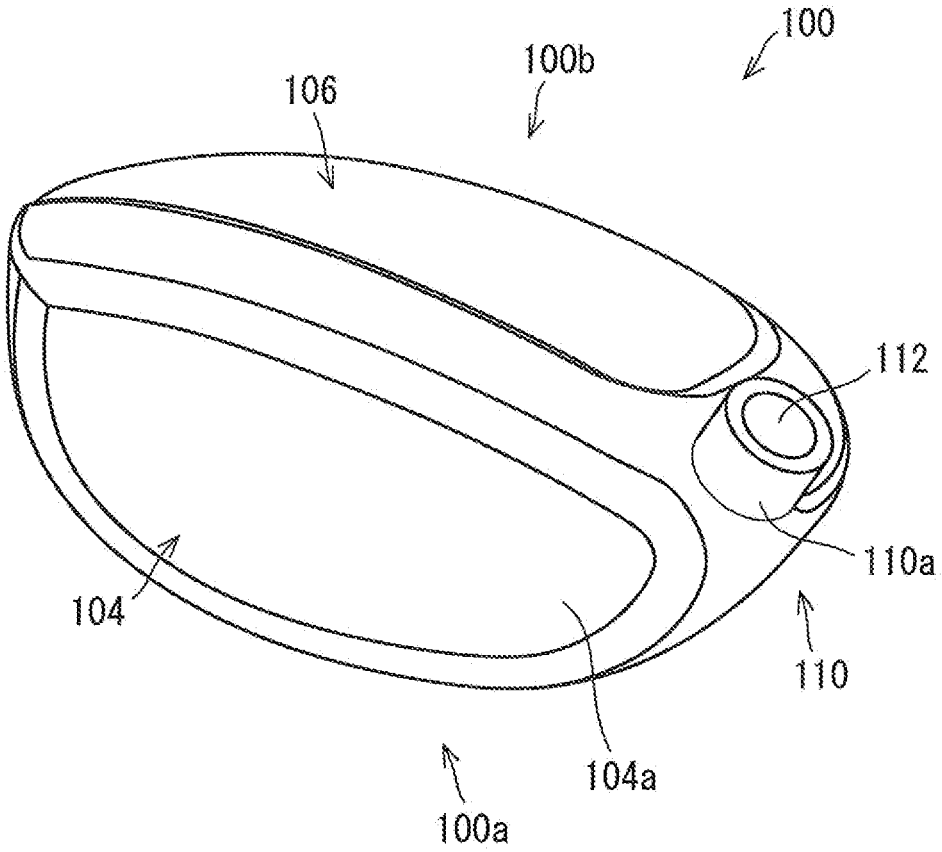
FIG. 2 is a perspective view of the head in FIG. 1.
Figure 3:
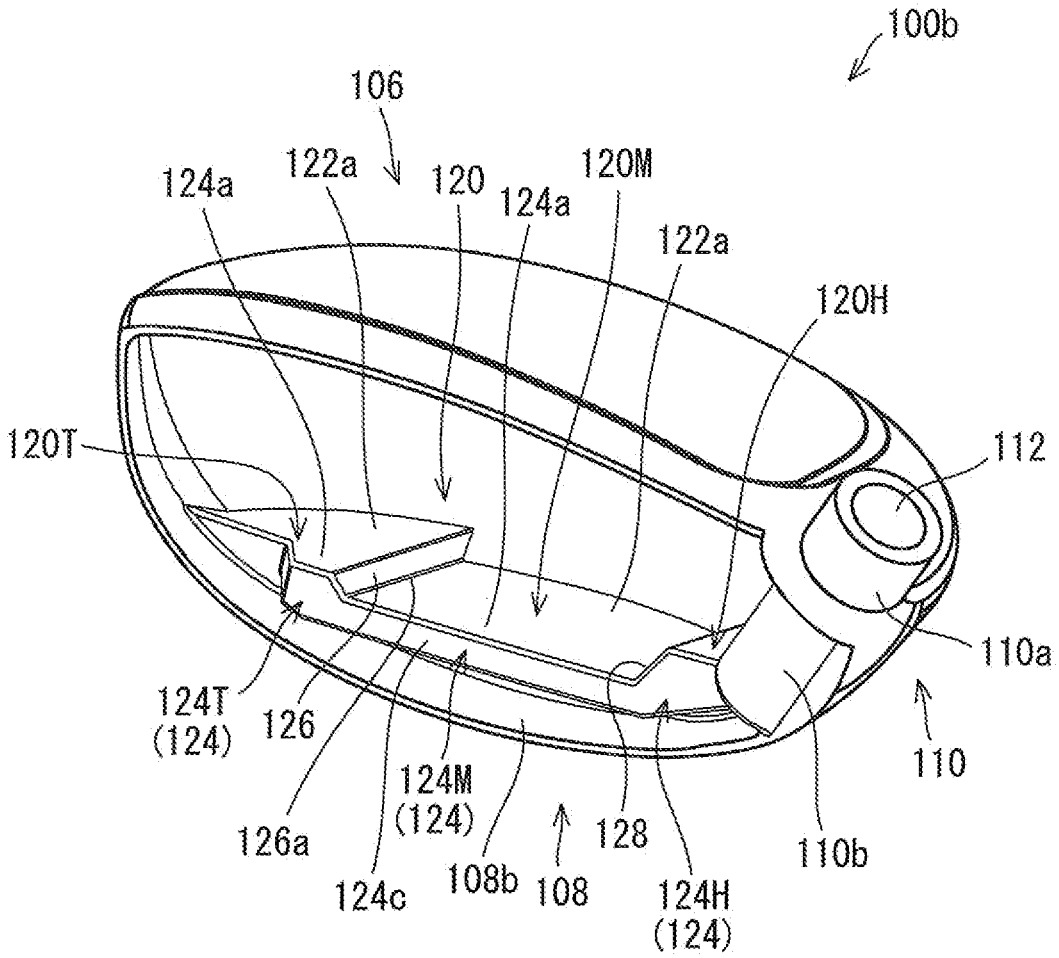
FIG. 3 is a perspective view of a body member of the head in FIG. 1.
Figure 4:
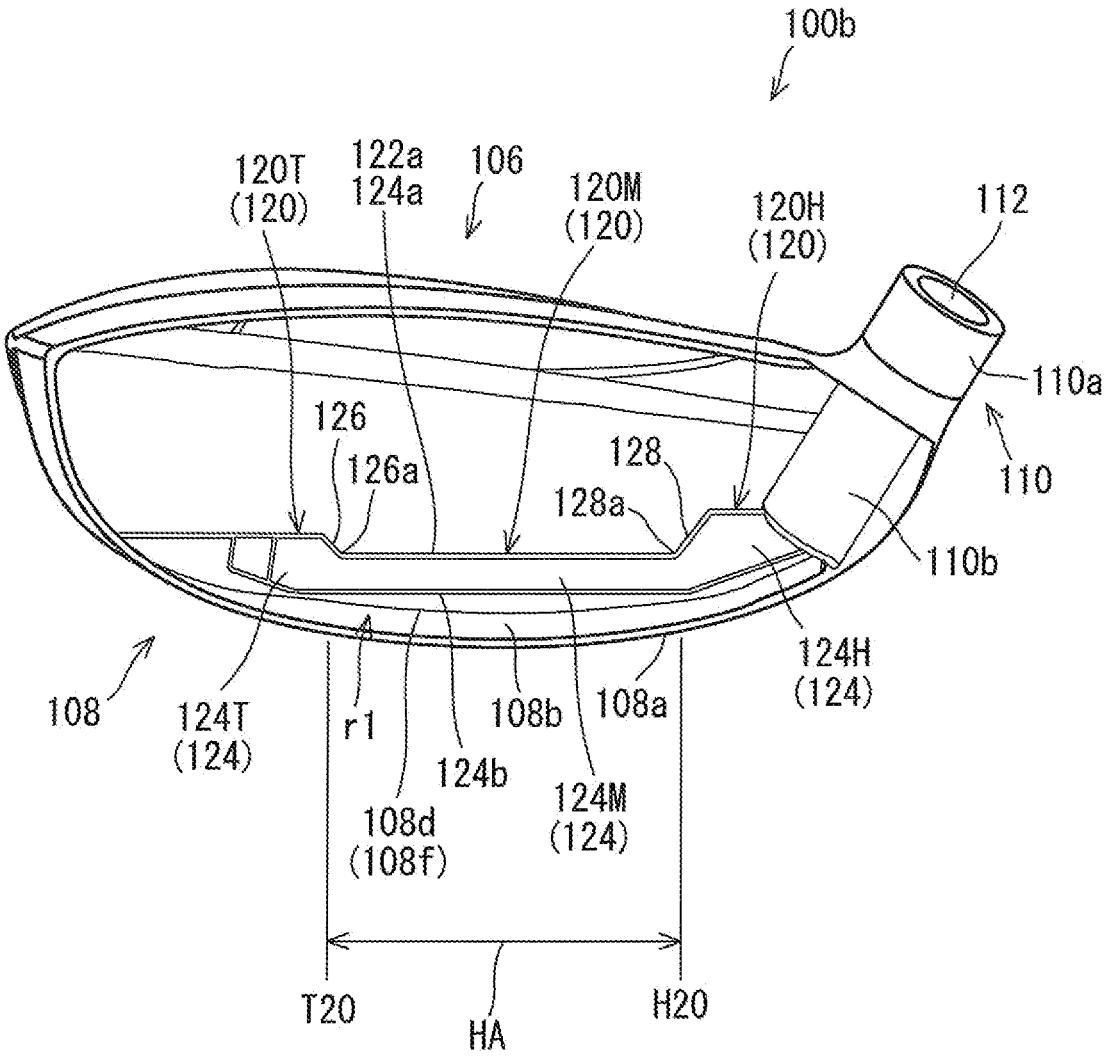
FIG. 4 is a front view of the body member in FIG. 3.
Figure 5:
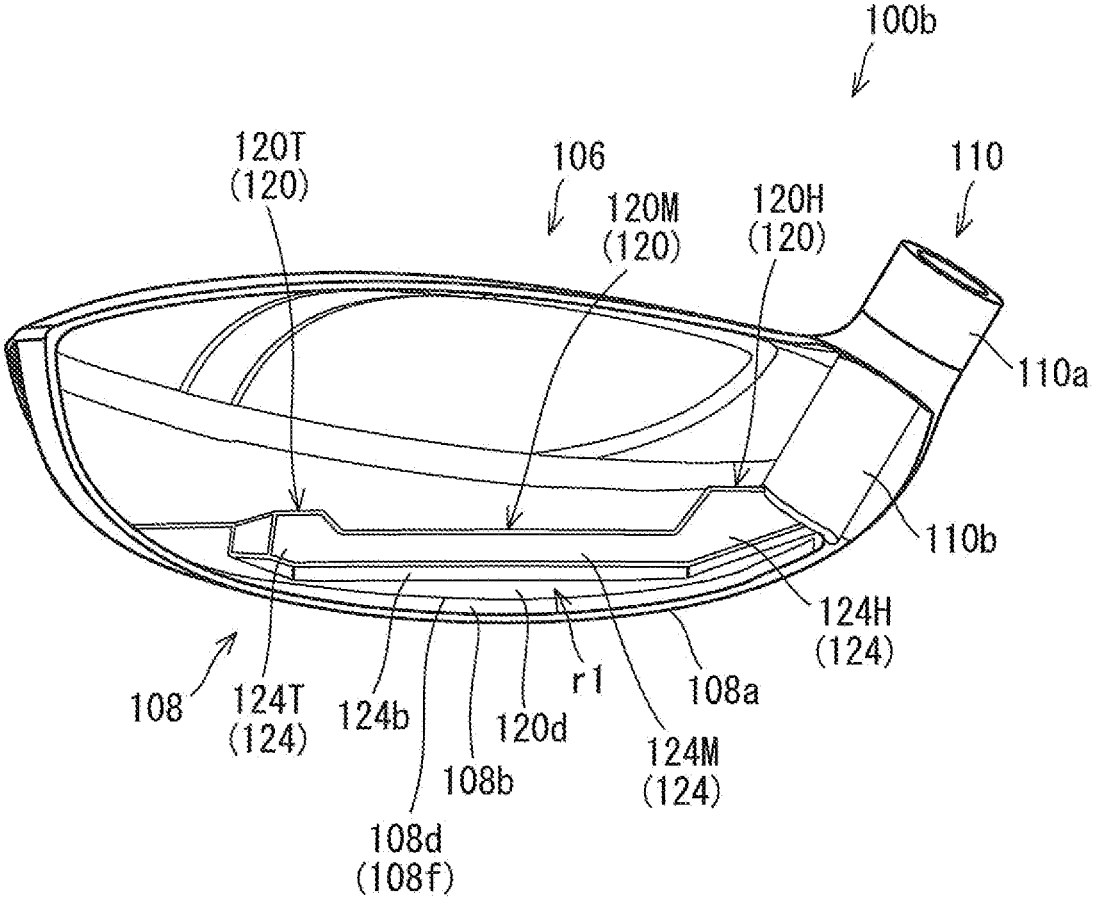
FIG. 5 shows the body member in FIG. 3 as viewed from a different angle from that in FIG. 4.
Figure 6A:
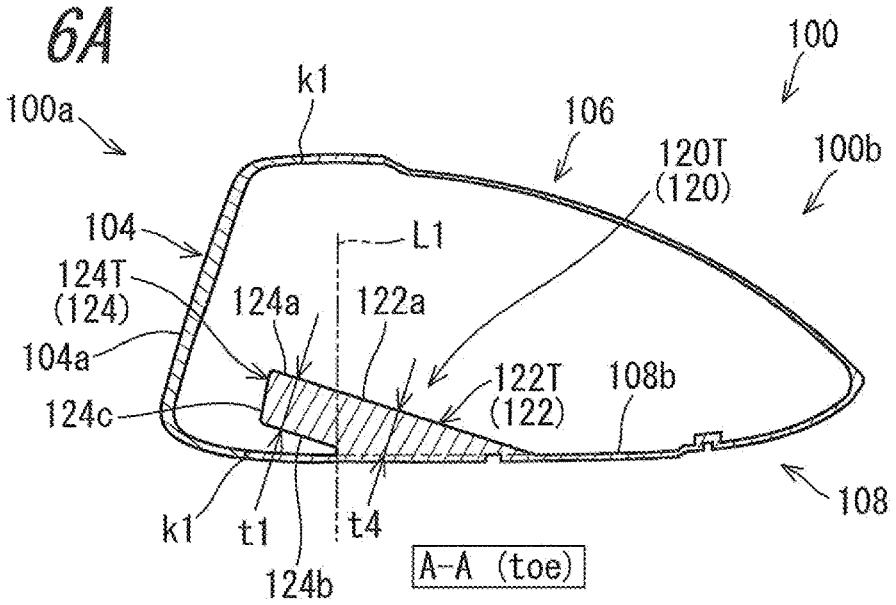
FIG. 6A is a cross-sectional view taken along line A-A in FIG. 1.
Figure 6B:
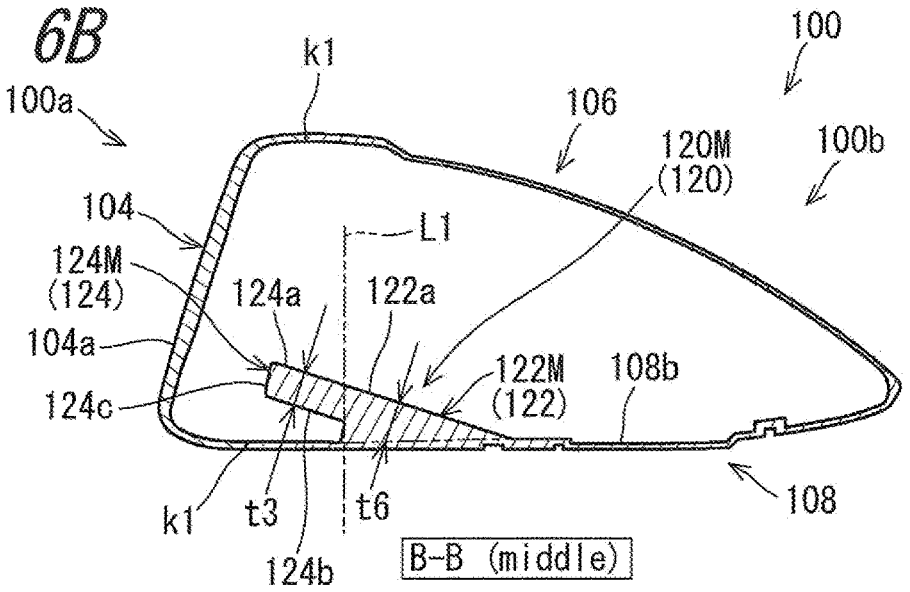
FIG. 6B is a cross-sectional view taken along line B-B in FIG. 1.
Figure 6C:
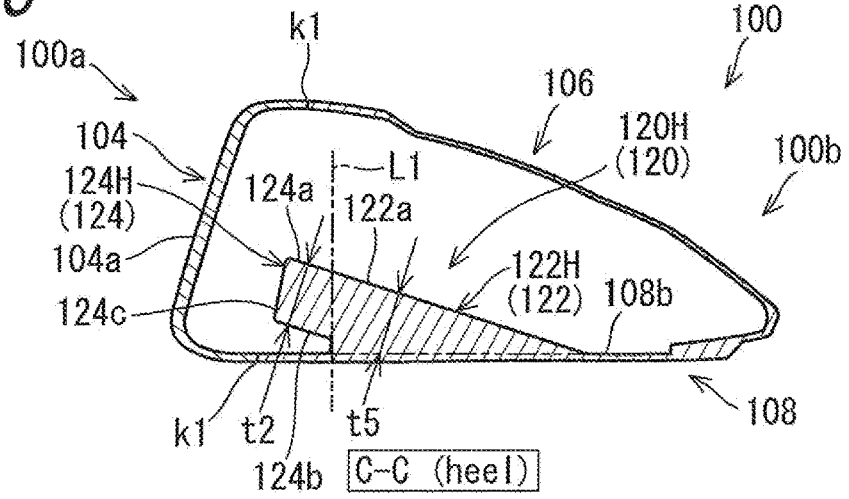
FIG. 6C is a cross-sectional view taken along line C-C in FIG. 1.

FIG. 1 is a plan view of a golf club head 100 according to the first embodiment. FIG. 2 is a perspective view of the head 100. FIG. 3 is a perspective view of a body member 100*b* of the head 100. FIG. 4 is a front view of the body member 100*b*. FIG. 5 shows the body member 100*b* when viewed from a viewpoint slightly lower as compared with FIG. 4. FIG. 6A is a cross-sectional view taken along line A-A in FIG. 1. FIG. 6B is a cross-sectional view taken along line B-B in FIG. 1. The center of gravity of the head (hereinafter, also referred to as head center of gravity) is present at a position on the cross-sectional plane taken along this line B-B. FIG. 6C is a cross-sectional view taken along line C-C in FIG. 1.

FIG. 6A, FIG. 6B, and FIG. 6C are cross-sectional views taken along the face-back direction. In the present disclosure, a cross-sectional view taken along the face-back direction is also referred to as a vertical cross-sectional view. In the reference state, a vertical cross-sectional view is a cross-sectional view taken along a plane that is parallel to the face-back direction and is perpendicular to the ground plane GP.

The head 100 includes a face portion 104, a crown portion 106, a sole portion 108, and a hosel portion 110. The sole portion 108 includes an outer surface 108*a* and an inner surface 108*b*. The hosel portion 110 includes an exposed part 110*a* exposed to outside of the head 100, and an inner extending part 110*b* positioned inside the head 100. The hosel portion 110 also has a hosel hole 112. The hosel hole 112 has an opening at an upper end of the exposed part 110*a*, and continuously extends from the exposed part 110*a* to the inner extending part 110*b*. The face portion 104 includes a striking face 104*a*. The striking face 104*a* is the outer surface of the face portion 104. The head 100 may include a skirt portion (side portion) that extends between the crown portion 106 and the sole portion 108. The striking face is also simply referred to as a face.

The head 100 is a hollow head. The head 100 is a wood type head. The head 100 is a fairway wood type head. The head 100 may be a hybrid type head. The head 100 may be a driver head.

From the viewpoint of components, the head 100 includes a face member 100*a* and the body member 100*b*. The face member 100*a* is welded to the body member 100*b*. In the head 100 which has been subjected to finishing polishing and coating, a boundary between the face member 100*a* and the body member 100*b* is not visually recognized. In FIG. 6A, FIG. 6B, and FIG. 6C, a boundary k1 between the face member 100*a* and the body member 100*b* is indicated.

In the cross-sectional views of FIG. 6A, FIG. 6B, and FIG. 6C, a part on the face side with respect to the boundary k1 is the face member 100*a*. The face member 100*a* has a cup shape as a whole. Such a face member 100*a* is also referred to as a cup face. The face member 100*a* includes an entirety of the face portion 104, a part of the crown portion 106, and a part of the sole portion 108. The face member 100*a* includes a main part that forms the face portion 104, and a backward extending portion that extends backward from a peripheral edge of the main part. The outer surface of the main part is the face portion 104, and the backward extending portion constitutes a part of the crown portion 106 and a part of the sole portion 108.

The face member 100*a* is made of a metal. Examples of the metal include stainless steel, maraging steel, a titanium alloy, an aluminum alloy, and a magnesium alloy. A part or an entirety of the face member 100*a* may be made of a non-metal material. For example, a part or the entirety of the face member 100*a* may be made of a carbon fiber reinforced resin.

The body member 100*b* is made of a metal. Examples of the metal include stainless steel, maraging steel, a titanium alloy, an aluminum alloy, and a magnesium alloy. A part or an entirety of the body member 100*b* may be made of a non-metal material. For example, a part or the entirety of the body member 100*b* may be made of a carbon fiber reinforced resin.

Figure 7:
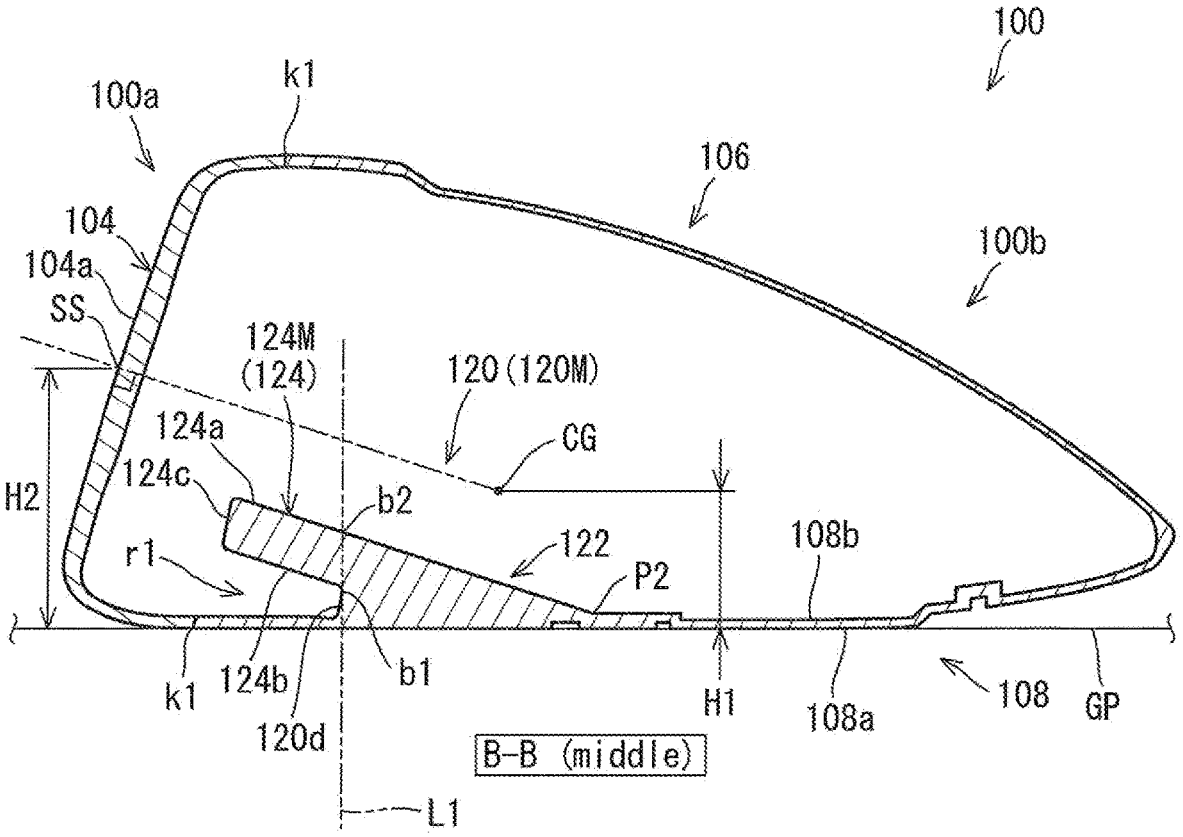
FIG. 7 is an enlarged view of FIG. 6B.
Figure 8:
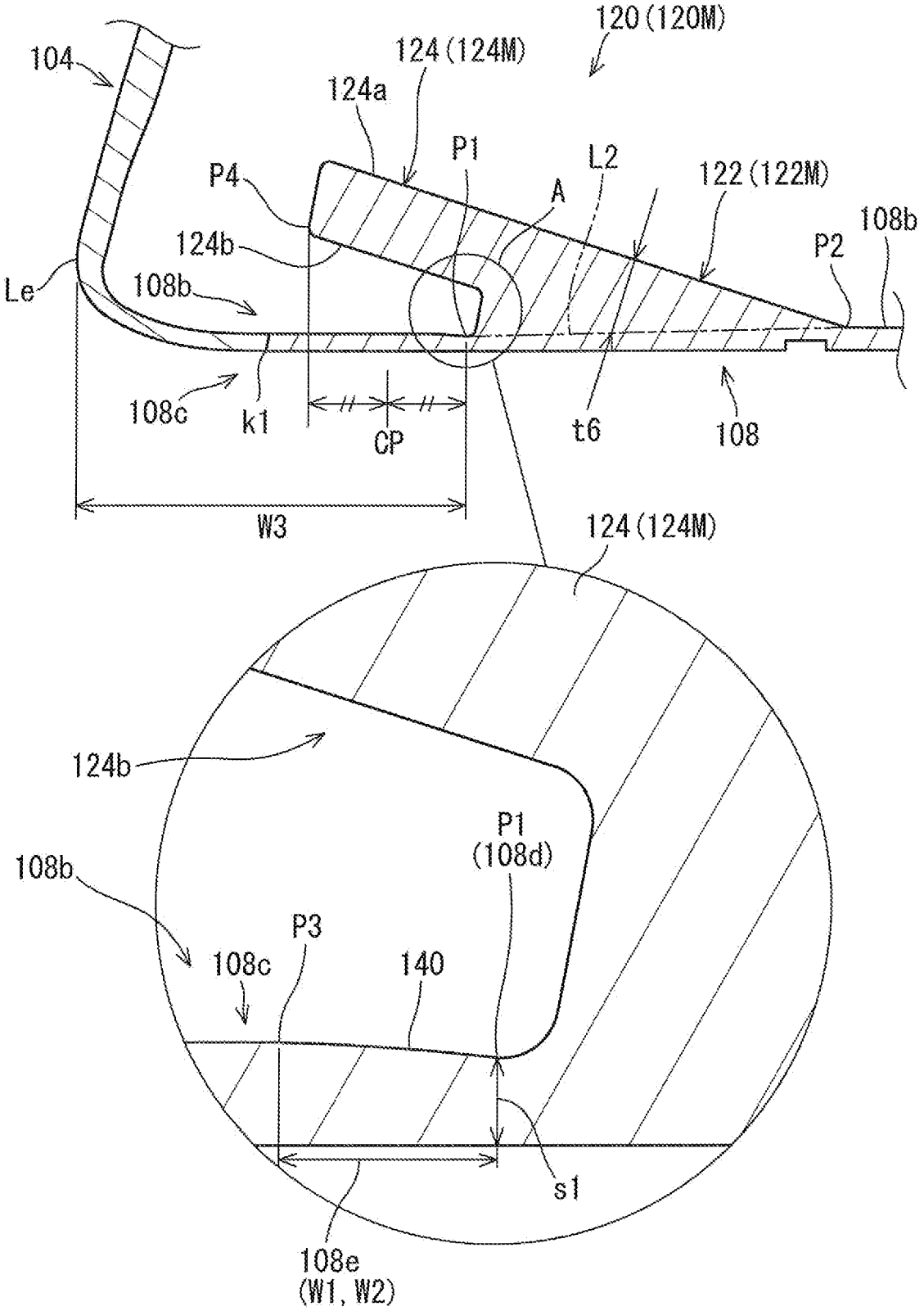
FIG. 8 is a partially enlarged view of FIG. 7.

FIG. 7 is an enlarged view of FIG. 6B. FIG. 8 is an enlarged view showing a part of FIG. 7.

The head 100 includes an internal weight portion 120. The body member 100*b* includes the internal weight portion 120. The internal weight portion 120 is provided on the inner side of the sole portion 108. The internal weight portion 120 is provided on the inner surface 108*b* of the sole portion 108.

The internal weight portion 120 is integrated with the sole portion 108. The internal weight portion 120 is formed integrally with the sole portion 108. The internal weight portion 120 is integrated with the body member 100*b*. The entirety of the body member 100*b* including the internal weight portion 120 is integrally formed as a single-piece member. The method for forming the body member 100*b* is casting. The body member 100*b* is formed by lost-wax precision casting. The internal weight portion 120 may be a different member from the sole portion 108. The internal weight portion 120 may be formed separately from the body member 100*b*. The internal weight portion 120 may be formed independently and fixed to the sole portion 108. Examples of this fixing method include welding, press fitting, screwing, and bonding.

The internal weight portion 120 is positioned on the back side with respect to the face portion 104. The internal weight portion 120 is located apart from the face portion 104.

The internal weight portion 120 includes a base portion 122, and a protruding portion 124 that protrudes from the base portion 122 toward the face side. The base portion 122 protrudes upward from the inner surface 108*b* of the sole portion 108. The base portion 122 is integrated with the inner surface 108*b*.

The protruding portion 124 is positioned on the face side with respect to the head center of gravity CG (see FIG. 7). An entirety of the protruding portion 124 is positioned on the face side with respect to the head center of gravity CG.

As shown in FIG. 7, the internal weight portion 120 and the sole portion 108 form a recess r1 that is opened toward the face side. In the vertical cross section, a backmost point b1 of a cross-sectional contour line that forms the recess r1 is specified. Further, in the vertical cross section, a straight line L1 that passes through the point b1 and extends in the up-down direction is specified. Furthermore, an intersection point b2 at which the straight line L1 intersects an upper surface of the internal weight portion 120 is specified. A line segment that extends from the point b1 to the point b2 can be defined as a boundary between the base portion 122 and the protruding portion 124.

The protruding portion 124 includes an upper surface 124*a* and a lower surface 124*b*. The protruding portion 124 also includes a front end face 124*c*. The front end face 124*c* is a face-side end face of the protruding portion 124. The front end face 124*c* extends from a front edge (face-side edge) of the upper surface 124*a* to a front edge (face-side edge) of the lower surface 124*b*. The front end face 124*c* does not have to be present. For example, when the protruding portion 124 has a pointed end, no front end face 124*c* is formed.

The upper surface 124*a* is inclined such that it goes upward as its proximity to the face portion 104 increases. The lower surface 124*b* is inclined such that it goes upward as its proximity to the face portion 104 increases. The upper surface 124*a* is parallel to the lower surface 124*b*. The upper surface 124*a* does not have to be parallel to the lower surface 124*b*.

The base portion 122 includes an upper surface 122*a*. The upper surface 122*a* is inclined such that it goes upward as its proximity to the face portion 104 increases. The upper surface 122*a* may be a flat surface, or may be a curved surface. In the present embodiment, the upper surface 122*a* is a single flat surface. The upper surface 122*a* extends until reaching the inner surface 108*b* of the sole portion 108, thereby terminating on the back side. The upper surface 122*a* is inclined such that it goes upward as its proximity to the protruding portion 124 increases. An entirety of the upper surface of the internal weight portion 120, including the upper surface 122*a* and the upper surface 124*a*, is inclined such that it goes upward as its proximity to the face portion 104 increases. In the internal weight portion 120, the upper surface 122*a* is flush with the upper surface 124*a*. The upper surface 122*a* and the upper surface 124*a* form a single flat surface. The upper surface 122*a* and the upper surface 124*a* do not have to be flush with each other.

As shown in FIG. 7, the internal weight portion 120 includes a rising surface 120*d*. The rising surface 120*d* forms a bottom surface of the above-described recess r1. When viewed from the viewpoint of FIG. 5, the rising surface 120*d* can be seen.

With reference to FIG. 6A, FIG. 6B, and FIG. 6C, the internal weight portion 120 includes a toe-side part 120T, a heel-side part 120H, and a middle part 120M. The toe-side part 120T is positioned on the toe side of the middle part 120M. The toe-side part 120T is adjacent to the middle part 120M. The heel-side part 120H is positioned on the heel side of the middle part 120M. The heel-side part 120H is adjacent to the middle part 120M. The middle part 120M is positioned between the toe-side part 120T and the heel-side part 120H. An entirety of the toe-side part 120T is positioned on the toe side with respect to the face center Fc. An entirety of the heel-side part 120H is positioned on the heel side with respect to the face center Fc. A region in the toe-heel direction in which the middle part 120M is disposed includes the position of the face center Fc in the toe-heel direction.

A toe-side part of the protruding portion 124 (hereinafter, also referred to as a toe protruding part 124T) has a first thickness t1. A heel-side part of the protruding portion 124 (hereinafter, also referred to as a heel protruding part 124H) has a second thickness t2. A middle part of the protruding portion 124 (hereinafter, also referred to as a middle protruding part 124M) has a third thickness t3. The third thickness t3 is smaller than the first thickness t1 and/or the second thickness t2. In the present embodiment, the third thickness t3 is smaller than the first thickness t1, and smaller than the second thickness t2. In the present embodiment, the second thickness t2 is greater than the first thickness t1. The thicknesses t1, t2, and t3 can be measured in respective directions of lines normal to the upper surface 124*a* at measured positions.

In the present disclosure, the terms of "first thickness t1", "second thickness t2", and "third thickness t3" are used, but these thicknesses do not have to be different from one another. For example, the first thickness t1 may be equal to the third thickness t3. Note that in the middle part 120M, the protruding portion 124 does not have to be present, as described below.

The protruding portion 124 includes the toe protruding part 124T, the heel protruding part 124H, and the middle protruding part 124M. The toe protruding part 124T is a toe-side part of the protruding portion 124. The toe protruding part 124T is contained in the toe-side part 120T. The heel protruding part 124H is a heel-side part of the protruding portion 124. The heel protruding part 124H is contained in the heel-side part 120H. The middle protruding part 124M is a part positioned between the toe-side part and the heel-side part in the protruding portion 124. The middle protruding part 124M is contained in the middle part 120M. The toe protruding part 124T is positioned on the toe side of the middle protruding part 124M. The toe protruding part 124T is adjacent to the middle protruding part 124M. The heel protruding part 124H is positioned on the heel side of the middle protruding part 124M. The heel protruding part 124H is adjacent to the middle protruding part 124M. As described above, the middle protruding part 124M does not have to be present.

As well illustrated in FIG. 3, the upper surface 122*a* and the upper surface 124*a* includes a toe-side step 126 and a heel-side step 128. The heel-side step 128 has a height greater than that of the toe-side step 126. These heights can be measured in the up-down direction. The toe-side step 126 and/or the heel-side step 128 does not have to be present.

According to the different thicknesses of the protruding portion 124, the internal weight portion 120 can be divided into the toe-side part 120T, the heel-side part 120H, and the middle part 120M. In the present embodiment, a lower edge 126*a* of the toe-side step 126 can be a boundary between the toe-side part 120T and the middle part 120M. Similarly, a lower edge 128*a* of the heel-side step 128 can be a boundary between the heel-side part 120H and the middle part 120M. The step 126 and/or the step 128 does not have to be present.

The upper surface 124*a* of the middle protruding part 124M is positioned on the lower side with respect to the upper surface 124*a* of the toe protruding part 124T and/or the upper surface 124*a* of the heel protruding part 124H. In the present embodiment, the upper surface 124*a* of the middle protruding part 124M is positioned on the lower side with respect to the upper surface 124*a* of the toe protruding part 124T, and is positioned on the lower side with respect to the upper surface 124*a* of the heel protruding part 124H.

Figure 9:
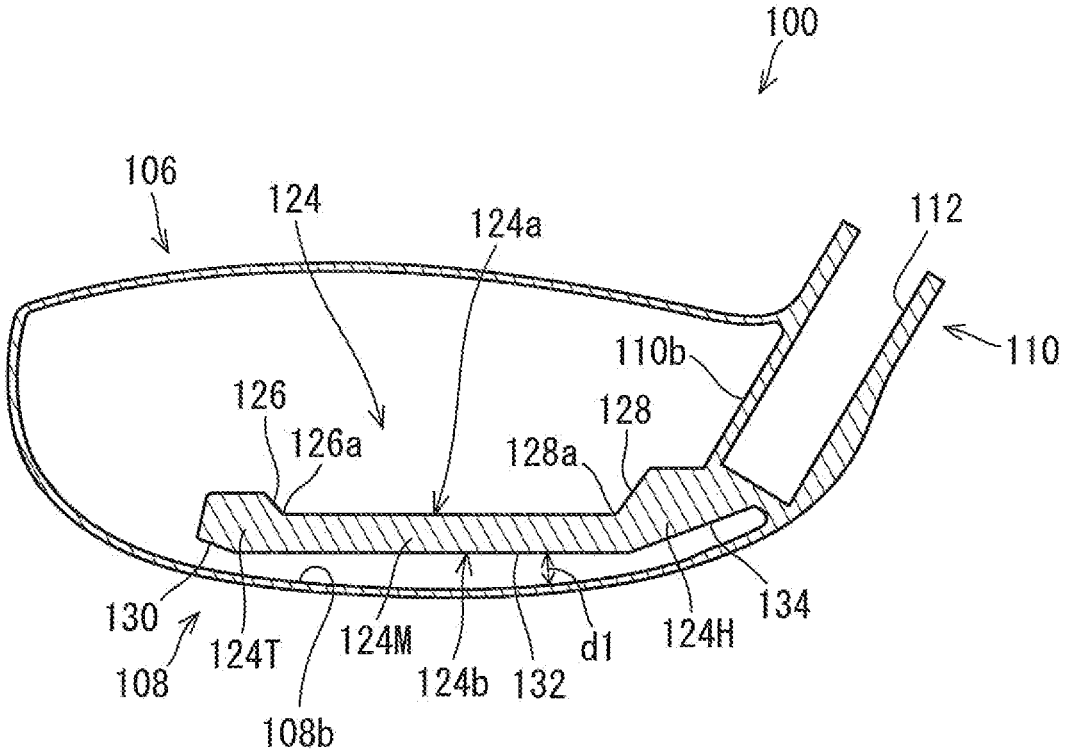
FIG. 9 is a cross-sectional view taken along line D-D in FIG. 1.
Figure 10:
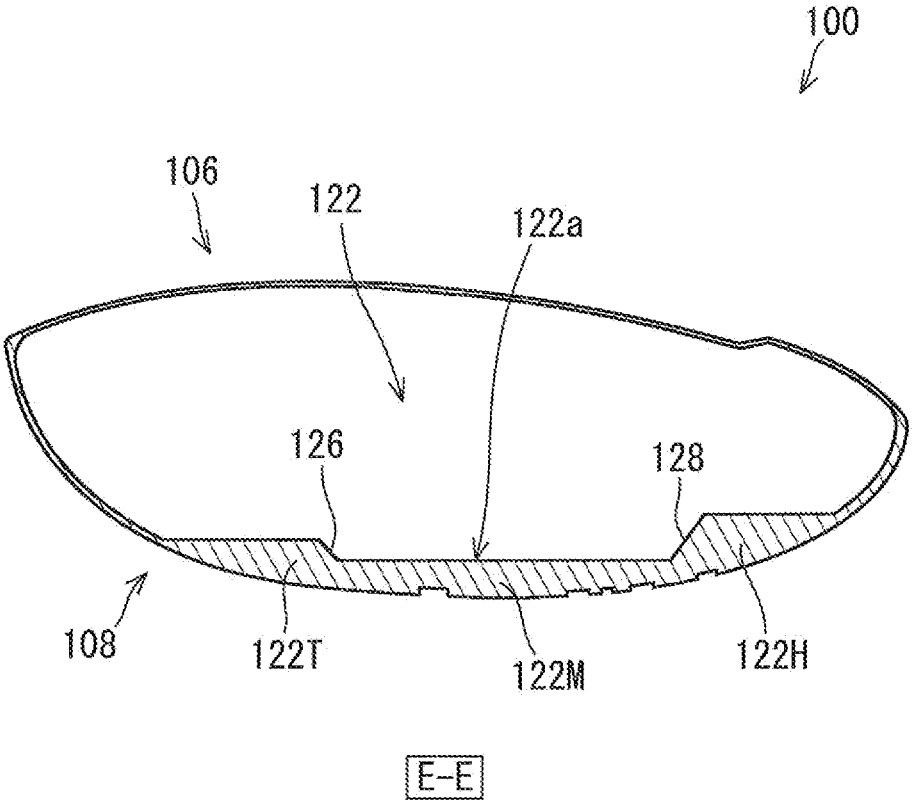
FIG. 10 is a cross-sectional view taken along line E-E in FIG. 1.

FIG. 9 is a cross-sectional view taken along line D-D in FIG. 1. FIG. 9 shows a cross section taken along the toe-heel direction at a position where the protruding portion 124 is present. FIG. 10 is a cross-sectional view taken along line E-E in FIG. 1. FIG. 10 shows a cross section taken along the toe-heel direction at a position where the base portion 122 is present.

As shown in FIG. 10, the base portion 122 includes a toe base part 122T, a heel base part 122H, and a middle base part 122M. The toe base part 122T is positioned on the back side of the toe protruding part 124T (the toe-side part of the protruding portion 124). The heel base part 122H is positioned on the back side of the heel protruding part 124H (the heel-side part of the protruding portion 124). The middle base part 122M is positioned on the back side of the middle protruding part 124M (the middle part of the protruding portion 124). The toe base part 122T is positioned on the toe side of the middle base part 122M. The toe base part 122T is adjacent to the middle base part 122M. The heel base part 122H is positioned on the heel side of the middle base part 122M. The heel base part 122H is adjacent to the middle base part 122M. The middle base part 122M is positioned between the toe base part 122T and the heel base part 122H.

As shown in FIG. 6A, the toe base part 122T has a fourth thickness t4. As shown in FIG. 6C, the heel base part 122H has a fifth thickness t5. As shown in FIG. 6B and FIG. 7, the middle base part 122M has a sixth thickness t6. The thicknesses t4, t5, and t6 can be measured in the direction perpendicular to the upper surface 122*a*. The thicknesses t4, t5, and t6 can be defined as thicknesses measured from a virtual boundary surface (to be described below) to the upper surface 122*a*. In other words, in a vertical cross section, the lower starting point for measurement of the thicknesses t4, t5, and t6 can be a position on a straight line L2 (or the straight line L1). The straight lines L2 and L1 are to be described below.

The average value of the fifth thickness t5 is greater than the average value of the sixth thickness t6. The average value of the fourth thickness t4 is greater than the average value of the sixth thickness t6. The average value of the fifth thickness t5 is greater than the average value of the fourth thickness t4. Each of these average values can be calculated from the volume and the surface area of the upper surface. For example, when the toe base part 122T has a volume of V1 and the upper surface 122*a* of the toe base part 122T has a surface area of S1, the average value of the fourth thickness t4 can be given as V1/S1. The volume of the heel base part 122H is greater than the volume of the toe base part 122T.

The average value of the thickness t5 is greater than the average value of the thickness t6, and the average value of the thickness t4 is greater than the average value of the thickness t6. The weight of the base portion 122 is largely allocated to the toe side and the heel side, which increases the lateral moment of inertia of the head 100. This can expand an area having a high rebound performance (hereinafter referred to as high rebound performance area). The average value of the thickness t5 is greater than the average value of the thickness t4. The weight of the base portion 122 is largely allocated to the heel side, which decreases a distance of the center of gravity (hereinafter also referred to as gravity center distance) of the head 100. This can improve ball catchability. The head 100 has a sweet spot SS positioned on the heel side with respect to the face center Fc.

The maximum value of the thickness t5 is greater than the maximum value of the thickness t6, and the maximum value of the thickness t4 is greater than the maximum value of the thickness t6. This increases the lateral moment of inertia of the head 100, and can expand the high rebound performance area. The maximum value of the thickness t5 is greater than the maximum value of the thickness t4. This decreases the gravity center distance of the head 100, and can improve the ball catchability.

A double-pointed arrow dl in FIG. 9 indicates a distance between the lower surface 124*b* of the protruding portion 124 and the inner surface 108*b* of the sole portion 108. This distance dl is measured in the direction of a line normal to the inner surface 108*b*. This distance dl is also referred to as an interspace distance. The interspace distance dl is measured on a cross section taken along the toe-heel direction.

As shown in FIG. 9, the lower surface 124*b* of the protruding portion 124 is formed so as to extend along the inner surface 108*b* of the sole portion 108, as viewed in the cross section taken along the toe-heel direction. The maximum value of the interspace distance dl on the cross section is denoted by dlmax, and the minimum value of the interspace distance dl on the cross section is denoted by dlmin. When [(dlmax−dlmin)/dlmax] is less than or equal to 0.6, it can be considered that the lower surface 124*b* of the protruding portion 124 is formed so as to extend along the inner surface 108*b* of the sole portion 108. [(dlmax−dlmin)/dlmax] is preferably less than or equal to 0.60, more preferably less than or equal to 0.55, and still more preferably less than or equal to 0.50. With a view to lowering the position of the head center of gravity, dlmax is preferably less than or equal to 8 mm, more preferably less than or equal to 7 mm, and still more preferably less than or equal to 6 mm. With a view to locating the protruding portion 124 apart from the inner surface 108*b* of the sole portion 108, dlmax is preferably greater than or equal to 1 mm, more preferably greater than or equal to 1.5 mm, and still more preferably greater than or equal to 2 mm. The position in the face-back direction of the cross section taken along the toe-heel direction is not limited. For example, the position of this cross section in the face-back direction can be a center position CP of the protruding portion 124 in the face-back direction. In the vertical cross section passing through the head center of gravity CG, a frontmost point (face-most point) P4 of the protruding portion 124 is specified (see FIG. 8). A position that divides a distance between the frontmost point P4 and a first contact point P1 (described below) into two equal parts in the face-back direction can be the center position CP in the face back direction.

On the lower surface 124*b* of the present embodiment, a first flat surface portion 130 that extends upward as it goes toward the toe side is formed in the toe protruding part 124T, a second flat surface portion 132 that is substantially parallel to the toe-heel direction is formed in the middle protruding part 124M, and a third flat surface portion 134 that extends upward as it goes toward the heel side is formed in the heel protruding part 124H. The lower surface 124*b* is constituted by such a plurality of flat surfaces, but is formed so as to extend along the inner surface 108*b* which is a curved surface.

A cross section taken along the toe-heel direction is specified at each position in the face-back direction. It is preferable that the lower surface 124*b* is formed so as to extend along the inner surface 108*b* at at least one position in the face-back direction. An example of this position is the center position CP described above. It is more preferable that the lower surface 124*b* is formed so as to extend along the inner surface 108*b* at every position in the face-back direction.

As shown in FIG. 9, the heel protruding part 124H is connected to the inner extending part 110*b* of the hosel portion 110. This configuration allows the protruding portion 124 to be located on further heel side, which can decrease the gravity center distance. Decreasing the gravity center distance promotes the face rotation of the head during a swing, whereby a head having excellent ball catchability can be obtained.

The "excellent ball catchability" means that the face 104*a* is unlikely to be opened at impact with a ball (hereinafter, "at impact with a ball" is also simply referred to as "at impact"). When a head having excellent ball catchability is used, the face 104*a* is likely to be square or slightly closed at impact. When a head having excellent ball catchability is used, the energy of the head is efficiently transmitted to a ball, which can produce a strong trajectory of the hit ball and increase the flight distance. The gravity center distance means a distance between the shaft axis line and the head center of gravity.

By the heel protruding part 124H and the inner extending part 110*b* connecting with each other, vibration of the heel protruding part 124H is suppressed. This can suppress vibration of the protruding portion 124 even when the middle protruding part 124M is made thinner. The suppression of vibration improves the durability of the protruding portion 124 and the internal weight portion 120. In addition, the suppression of vibration can contribute to improvement of feel at impact. If vibration of the protruding portion 124 is transmitted to golfer's hands, the feel at impact can deteriorate. The feel at impact can be improved by suppressing this vibration.

As described above, in the present embodiment, the thickness t2 of the heel-side part of the protruding portion 124 (heel protruding part 124H) is greater than the thickness t1 of the toe-side part of the protruding portion 124 (toe protruding part 124T). This configuration can decrease the gravity center distance of the head 100. Decreasing the gravity center distance promotes the face rotation, whereby a head having excellent ball catchability can be obtained.

The heel protruding part 124H has a volume greater than that of the toe protruding part 124T. This configuration can decrease the gravity center distance of the head 100. By decreasing the gravity center distance, a head having excellent ball catchability can be obtained. FIG. 8 is an enlarged cross-sectional view of a part of FIG. 7. FIG. 8 includes an enlarged portion in which the inside of circle A is further enlarged.

A point of contact on the face side between the internal weight portion 120 and the inner surface 108*b* of the sole portion 108 is defined as the first contact point P1. A vertex of an angular corner or a point having the smallest radius of curvature in the boundary portion on the face side between the internal weight portion 120 and the inner surface 108*b* can be the first contact point P1. When a part at which the radius of curvature is the smallest is not a point but an arc, an end point of the arc on the face side can be the first contact point P1. As shown in FIG. 8, in the present embodiment, the part at which the radius of curvature is the smallest is an arc, and the end point of the arc on the face side is the first contact point P1. The first contact point P1 is determined on a vertical cross section.

A point of contact on the back side between the internal weight portion 120 and the inner surface 108*b* of the sole portion 108 is defined as a second contact point P2. A vertex of an angular corner or a point having the smallest radius of curvature in the boundary portion on the back side between the internal weight portion 120 and the inner surface 108*b* can be the second contact point P2. When a part at which the radius of curvature is the smallest is not a point but an arc, an end point of the arc on the back side can be the second contact point P2. As shown in FIG. 8, in the present embodiment, the second contact point P2 is the vertex of an angular corner. The second contact point P2 is determined on a vertical cross section.

When the internal weight portion 120 is formed separately from the body member 100*b*, a boundary surface that separates the base portion 122 from the sole portion 108 can be present. In the present embodiment, the base portion 122 is integrated with the sole portion 108, and no boundary surface is present. In this case, a virtual boundary surface that separates the base portion 122 from the sole portion 108 can be defined. A vertical cross section can be set at any position in the toe-heel direction. On each vertical cross section, a line segment L2 that extends from the first contact point P1 to the second contact point P2 can be determined (see FIG. 8). A set of the line segments L2 can be defined as the virtual boundary surface. This virtual boundary surface can separate the internal weight portion 120 from the sole portion 108. With the boundary surface or the virtual boundary surface, an independent internal weight portion 120 can be defined. As a result, for example, the volume of the base portion 122 and the thickness of the base portion 122 can be determined.

A double-pointed arrow s1 in FIG. 8 indicates a wall thickness of the sole portion 108 at the first contact point P1. The wall thickness s1 is measured in the up-down direction. In the present disclosure, the wall thickness of the sole portion 108 is measured in the up-down direction.

The sole portion 108 includes a sole front part 108*c* that has a wall thickness greater than the wall thickness s1. The sole front part 108*c* is positioned on the face side with respect to the first contact point P1. In the present embodiment, the sole front part 108*c* is adjacent to the first contact point P1. Alternatively, the sole front part 108*c* may be located apart from the first contact point P1.

The sole front part 108*c* having a wall thickness greater than the wall thickness s1 extends from the first contact point P1 toward the face side, extending at least to reach the boundary k1. The length of the sole front part 108*c* in the face-back direction is not limited. The sole portion 108 includes a first thin part 108*d*.

The wall thickness s1 at the first contact point P1 is smaller than the wall thickness of the sole front part 108*c*, whereby the first thin part 108*d* is formed at the position of the first contact point P1. A part of the sole portion 108 positioned at the first contact point P1 is referred to as the first thin part 108*d*. The sole portion 108 includes the first thin part 108*d* thinner than the sole front part 108*c* at the position of the first contact point P1. Whether or not the first thin part 108*d* is formed is determined on a vertical cross section. The wall thickness s1 of the first thin part 108*d* can vary depending on the position in the toe-heel direction.

In the present embodiment, the first thin part 108*d* is the thinnest in a region extending from the first contact point P1 to the boundary k1. In the present embodiment, the first thin part 108*d* is the thinnest in a region extending from the first contact point P1 to a leading edge Le.

The sole portion 108 includes a thickness transition part 108*e*. The wall thickness of the thickness transition part 108*e* continuously decreases as its proximity to the first contact point P1 increases. The thickness transition part 108*e* has an upper surface 140. The upper surface 140 is a part of the inner surface 108*b* of the sole portion 108. The upper surface 140 is inclined such that it goes downward as its proximity to the first contact point P1 increases. In the embodiment shown in FIG. 8, a part extending from the first contact point P1 to a point P3 is the thickness transition part 108*e*. The point P3 is positioned in the sole front part 108*c*. The point P3 is a face-most point in the upper surface 140 of the thickness transition part 108*e*. In the present embodiment, the wall thickness of the entirety of the thickness transition part 108*e* is greater than or equal to the wall thickness s1. The thickness transition part 108*e* may include a part having a wall thickness smaller than the wall thickness s1.

In the present embodiment, the thickness transition part 108*e* is in contact with the first contact point P1. The thickness transition part 108*e* starts from the first contact point P1. The first contact point P1 and the thickness transition part 108*e* may be located apart from each other. For example, a part having a uniform wall thickness may be present between the first contact point P1 and the thickness transition part 108*e*. For example, a part having a wall thickness that increases toward the first contact point P1 may be present between the first contact point P1 and the thickness transition part 108*e*. A part having a wall thickness smaller than the wall thickness s1 may be present between the first contact point P1 and the thickness transition part 108*e*.

The thickness transition part 108*e* contributes to alleviation of stress concentration at the first thin part 108*d*. In addition, the thickness transition part 108*e*, having a thickness smaller than that at the point P3, contributes to a higher degree of deformation of the face portion 104 at impact. These are synergistic effects brought by the thickness transition part 108*e* and the first thin part 108*d*.

The thickness transition part 108*e* is provided in the vicinity of the first contact point P1. The above-described synergistic effects are enhanced by positioning the thickness transition part 108*e* in the vicinity of the first contact point P1. This "vicinity" can mean that the distance between the thickness transition part 108*e* and the first contact point P1 is less than or equal to 5 mm. This distance is measured in the face-back direction. A double-pointed arrow W1 in FIG. 8 indicates a distance between the point P3 and the first contact point P1. From the viewpoint of the synergistic effects of the first thin part 108*d* and the thickness transition part 108*e*, the distance W1 is preferably less than or equal to 5 mm, more preferably less than or equal to 4 mm, and still more preferably less than or equal to 3 mm. This distance W1 is measured in the face-back direction.

A double-pointed arrow W2 in FIG. 8 indicates a width of the thickness transition part 108*e*. The width W2 is measured in the face-back direction. In the present embodiment, the width W2 is equal to the distance W1. The width W2 may be different from the distance W1.

With a view to alleviating the stress concentration at the first thin part 108*d* and obtaining a higher degree of deformation of the face portion 104, the width W2 is preferably greater than or equal to 0.6 mm, more preferably greater than or equal to 0.8 mm, and still more preferably greater than or equal to 1.0 mm. An excessively large width W2 leads to an excessively small angle of inclination of the upper surface 140, which can decrease the effect of alleviating the stress concentration. From this viewpoint, the width W2 is preferably less than or equal to 5 mm, more preferably less than or equal to 4 mm, and still more preferably less than or equal to 3 mm.

As shown in FIG. 6B, FIG. 7, and FIG. 8, the first thin part 108*d* is formed on the face side of the middle part 120M. In other words, the first thin part 108*d* is formed in a region in the toe-heel direction in which the middle part of the protruding portion 124 (the middle protruding part 124M) is present. The thickness transition part 108*e* is also formed on the face side of the middle part 120M. The first thin part 108*d* and the thickness transition part 108*e* can enhance the rebound performance in a middle region of the face portion 104. As shown in FIG. 6A, the first thin part 108*d* is not formed on the face side of the toe-side part 120T. In other words, the first thin part 108*d* is not formed in a region in the toe-heel direction in which the toe-side part of the protruding portion 124 (the toe protruding part 124T) is present. The thickness transition part 108*e* is not formed on the face side of the toe-side part 120T, either. As shown in FIG. 6C, the first thin part 108*d* is not formed on the face side of the heel-side part 120H. In other words, the first thin part 108*d* is not formed in a region in the toe-heel direction in which the heel-side part of the protruding portion 124 (the heel protruding part 124H) is present. The thickness transition part 108*e* is not formed on the face side of the heel-side part 120H, either. With the configuration in which no thin part is formed on the toe side and the heel side, the lateral moment of inertia can be improved.

On the vertical cross section passing through the head center of gravity CG, a back-side end of the internal weight portion 120 is positioned on the back side with respect to the head center of gravity CG (see FIG. 7). In the present embodiment, the back-side end of the internal weight portion 120 is the second contact point P2. On the other hand, as described above, the center of gravity of the protruding portion 124 is positioned on the face side with respect to the head center of gravity CG. In addition, the center of gravity of the internal weight portion 120 is positioned on the face side with respect to the head center of gravity CG. As shown in FIG. 7, of the base portion 122, a part whose upper surface 122*a* is inclined such that it goes downward as it goes to the back side extends to the back side with respect to the head center of gravity CG. With this configuration, more weight can be allocated to a lower side portion of the head 100. On the other hand, by positioning the center of gravity of the protruding portion 124 on the face side with respect to the head center of gravity CG, a depth of the center of gravity (hereinafter also referred to as gravity center depth) is decreased. By the synergistic effect of these, the position of the sweet spot SS is lowered. This effect is further enhanced by positioning the center of gravity of the internal weight portion 120 on the face side with respect to the head center of gravity CG. This effect is further enhanced by positioning the center of gravity of the base portion 122 on the face side with respect to the head center of gravity CG.

With reference to FIG. 6A, FIG. 6B, and FIG. 6C, the lower surface 124*b* of the protruding portion 124 and the inner surface 108*b* of the sole portion 108 are opposed to each other such that no undercut is formed. That is, a draft angle is formed between the lower surface 124*b* and the inner surface 108*b*, or the lower surface 124*b* is parallel to the inner surface 108*b*. In the present embodiment, the draft angle is formed. More specifically, the distance between the lower surface 124*b* and the inner surface 108*b* continuously increase toward an opening of the recess r1. This makes it easier to remove a mold when the sole portion 108 and the internal weight portion 120 are integrally formed as a single-piece member. When the lost wax precision casting is used, this makes it easier to remove a mold for wax forming. If an undercut is formed, it can be necessary to divide a mold to cope with the undercut, but the above-described configuration makes it possible to avoid this division.

With reference to the enlarged portion of FIG. 8, the lower surface 124*b* of the protruding portion 124 and the upper surface 140 of the thickness transition part 108*e* are opposed to each other such that no undercut is formed. That is, a draft angle is formed between the lower surface 124*b* and the upper surface 140, or the lower surface 124*b* is parallel to the upper surface 140. In the present embodiment, the draft angle is formed. More specifically, the distance between the lower surface 124*b* and the upper surface 140 continuously increases toward the opening of the recess r1. This makes it easier to remove a mold when the sole portion 108 and the internal weight portion 120 are integrally formed as a single-piece member. When the lost wax precision casting is used, this makes it easier to remove a mold for wax forming. If an undercut is formed, it can be necessary to divide a mold to cope with the undercut, but the above-described configuration makes it possible to avoid this division.

Figure 11:
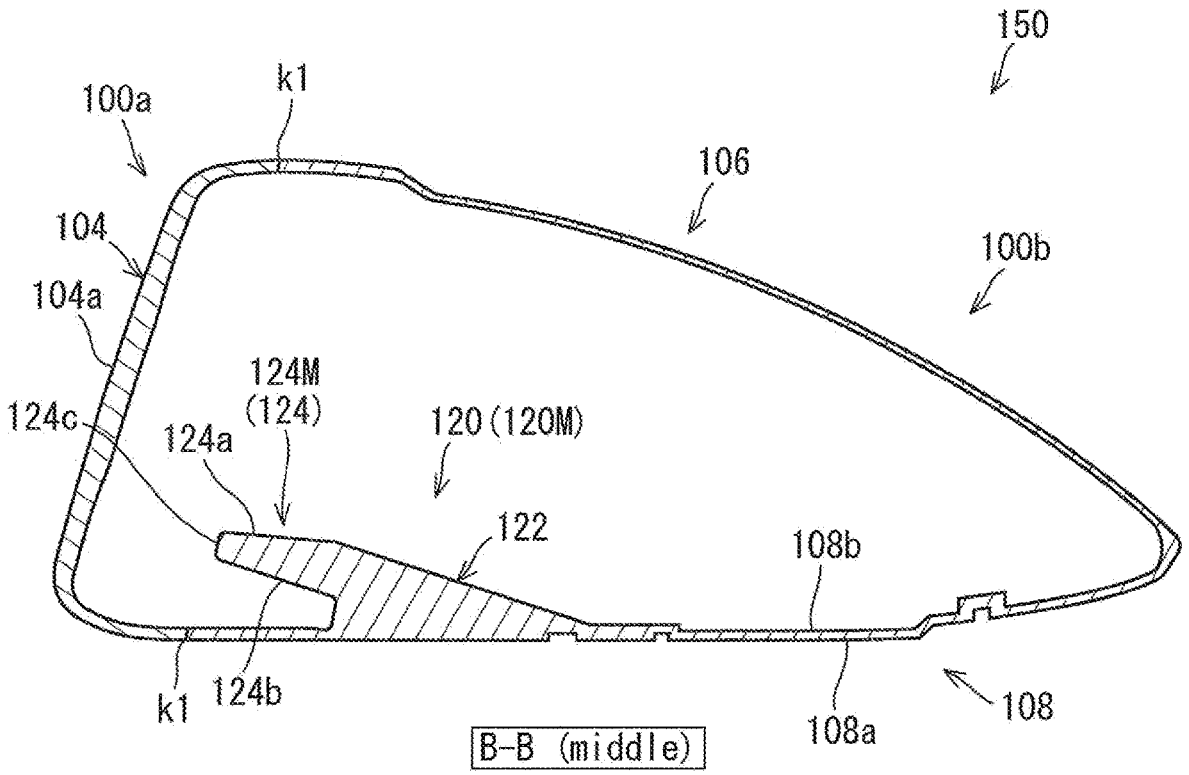
FIG. 11 is a cross-sectional view of a modification example of the first embodiment.

FIG. 11 is a vertical cross-sectional view of a head 150 that is a modification example of the first embodiment. The position of the cross section of FIG. 11 is the same as that of line B-B in FIG. 1. The head 150 is the same as the head 100 except for the angle of inclination of the upper surface 124*a* of the protruding portion 124.

Also in the head 150, the upper surface 124*a* is inclined such that it goes upward as its proximity to the face portion 104 increases. The upper surface 124*a*, however, is not parallel to the lower surface 124*b* in the head 150. The upper surface 124*a* is inclined such that the thickness of the protruding portion 124 decreases toward the face portion 104. A tapered portion that has a thickness decreasing toward its tip end is formed in the protruding portion 124. This configuration makes it further easier to remove a mold when the sole portion 108 and the internal weight portion 120 are integrally formed as a single-piece member.

When the thickness of the protruding portion 124 varies, similar to the head 150, the first thickness t1, the second thickness t2, and the third thickness t3 can be considered as respective average values. Each of the average values can be calculated from the volume and the surface area of the upper surface. For example, when the toe protruding part 124T has a volume of Va and the upper surface 124*a* of the toe protruding part 124T has a surface area of Sa, the average value of the first thickness t1 can be given as Va/Sa.

A double-pointed arrow HA in FIG. 4 indicates an impact area. A position located 0.84 inches (21.335 mm) apart from the face center Fc toward the toe side is referred to as a position T20. A position located 0.84 inches apart from the face center Fc toward the heel side is referred to as a position H20. A region extending from the position T20 to the position H20 is the impact area HA. The impact area HA has a length (length in the toe-heel direction) of 1.68 inches.

In the present embodiment, an entirety of the middle part 120M is present in the impact area HA. An entirety of the middle base part 122M is present in the impact area HA. An entirety of the middle protruding part 124M is present in the impact area HA.

With a view to expanding the high rebound performance area in the toe-heel direction, the first thin part 108*d* preferably extend from the toe side to the heel side to form a sideward extending part 108*f*. The first thin part 108*d* is preferably disposed over a region that occupies 80% or more of the impact area HA. That is, the sideward extending part 108*f* present in the impact area HA preferably has a length in the toe-heel direction of greater than or equal to 80% of the length of the impact area HA. This configuration can improve the rebound performance in a face region (a region on the face) having a high probability of striking balls.

With a view to improving the rebound performance in the impact area HA and improving the lateral moment of inertia, an entirety of the sideward extending part 108*f* is preferably provided in the impact area HA. With a view to improving the lateral moment of inertia, no first thin part 108*d* is preferably formed on the toe side and on the heel side with respect to the impact area HA. With a view to improving the lateral moment of inertia, no first thin part 108*d* is preferably formed on the toe side with respect to the sideward extending part 108*f*, and no first thin part 108*d* is preferably provided on the heel side with respect to the sideward extending part 108*f*. With a view to improving the lateral moment of inertia, the wall thickness s1 on the toe side with respect to the sideward extending part 108*f* is preferably greater than the wall thickness s1 in the sideward extending part 108*f*. With a view to improving the lateral moment of inertia, the wall thickness s1 on the heel side with respect to the sideward extending part 108*f* is preferably greater than the wall thickness s1 in the sideward extending part 108*f*.

The toe-side part 120T includes a part located on the toe side with respect to the position T20. The toe base part 122T includes a part located on the toe side with respect to the position T20. The toe protruding part 124T includes a part located on the toe side with respect to the position T20. The heel-side part 120H includes a part located on the heel side with respect to the position H20. The heel base part 122H includes a part located on the heel side with respect to the position H20. The heel protruding part 124H includes a part located on the heel side with respect to the position H20. These configurations contribute to improvement of the lateral moment of inertia.

Second Embodiment

Figure 12:
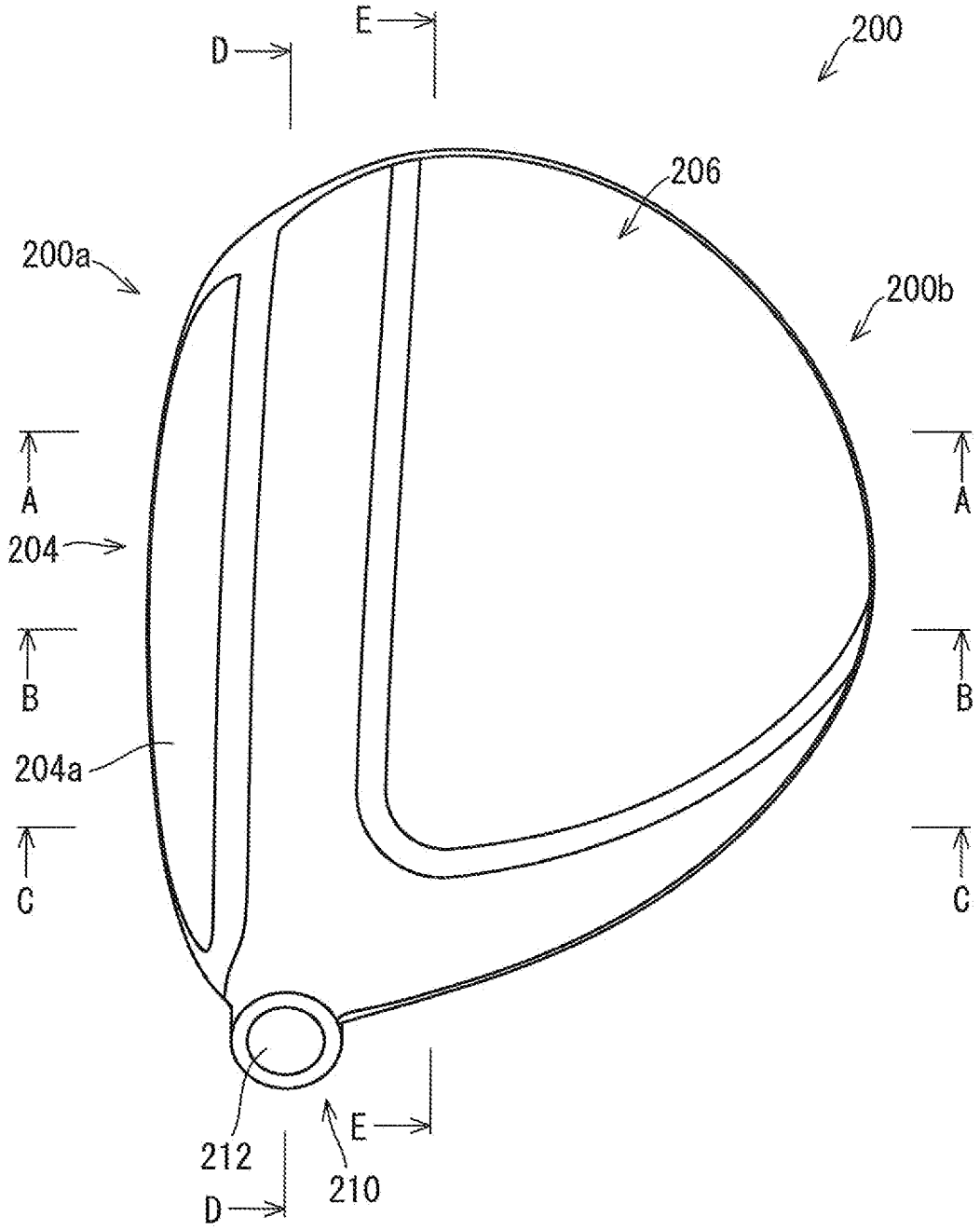
FIG. 12 is a plan view of a golf club head according to a second embodiment.
Figure 13:
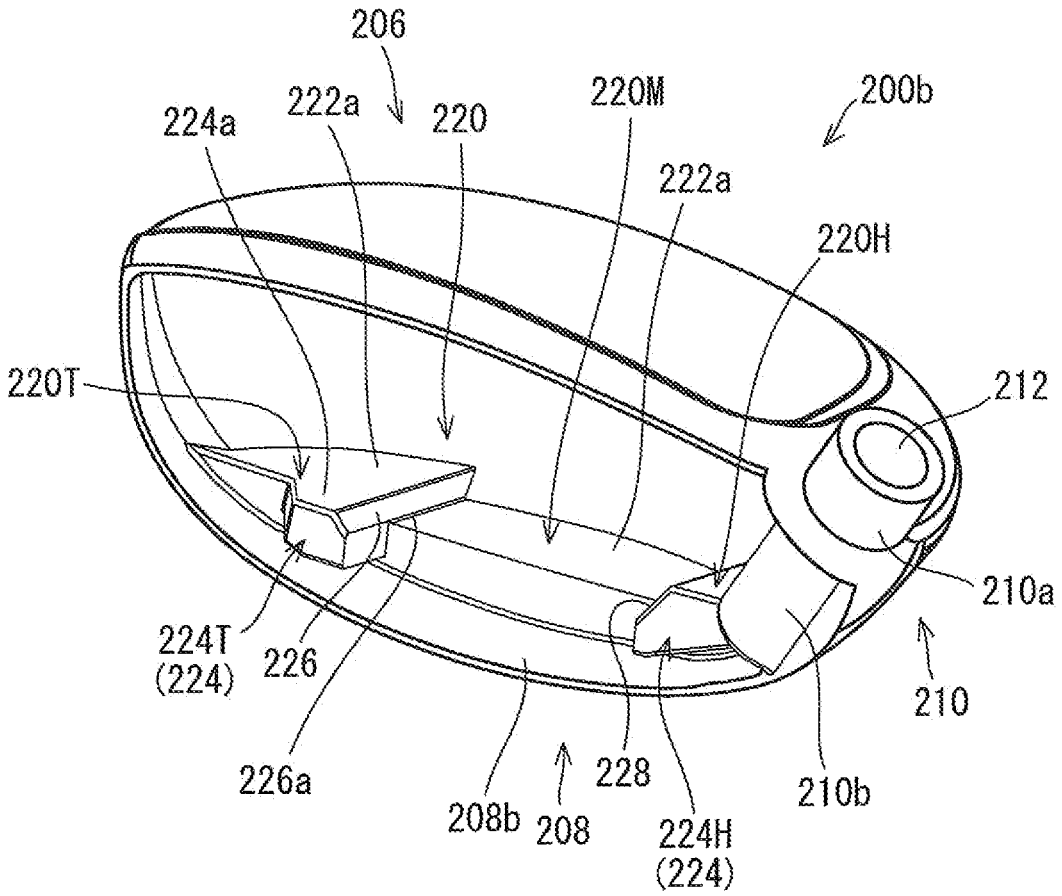
FIG. 13 is a perspective view of a body member of the head in FIG. 12.
Figure 14:
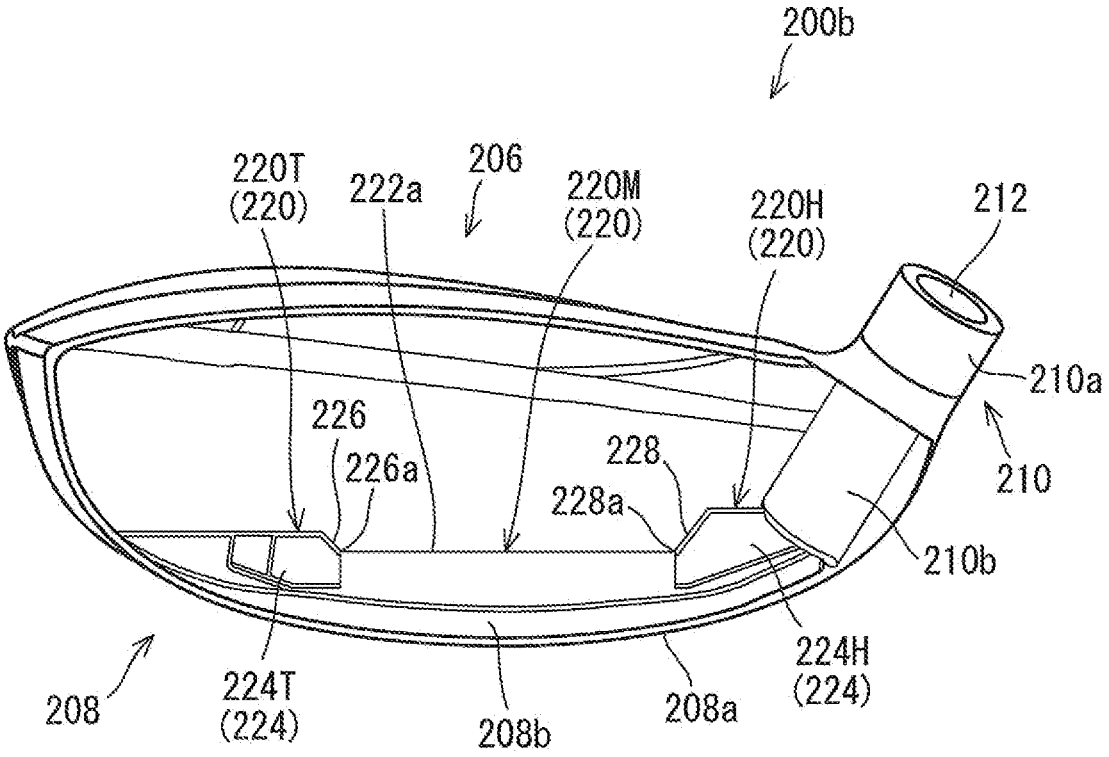
FIG. 14 is a front view of the body member in FIG. 13.
Figure 15A:
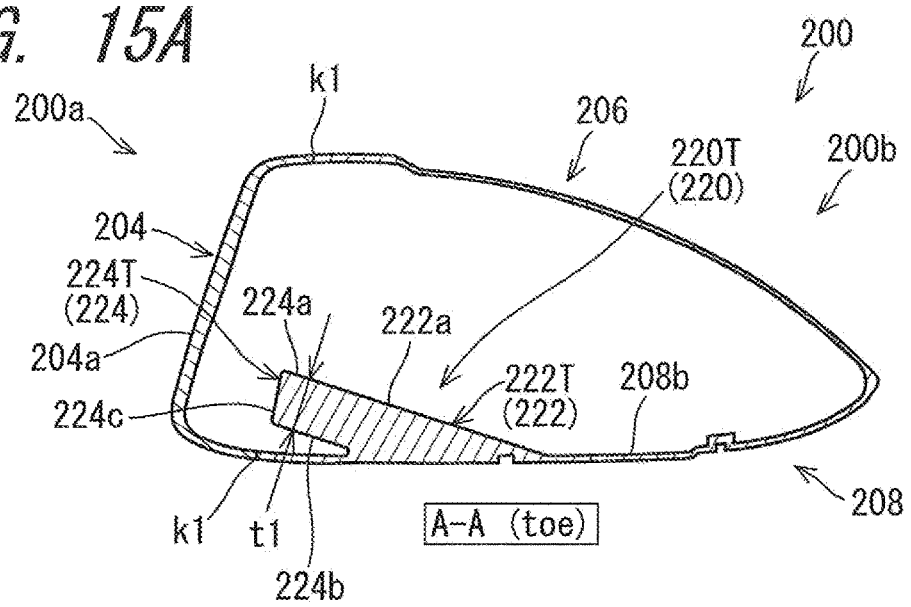
FIG. 15A is a cross-sectional view taken along line A-A in FIG. 12.
Figure 15B:
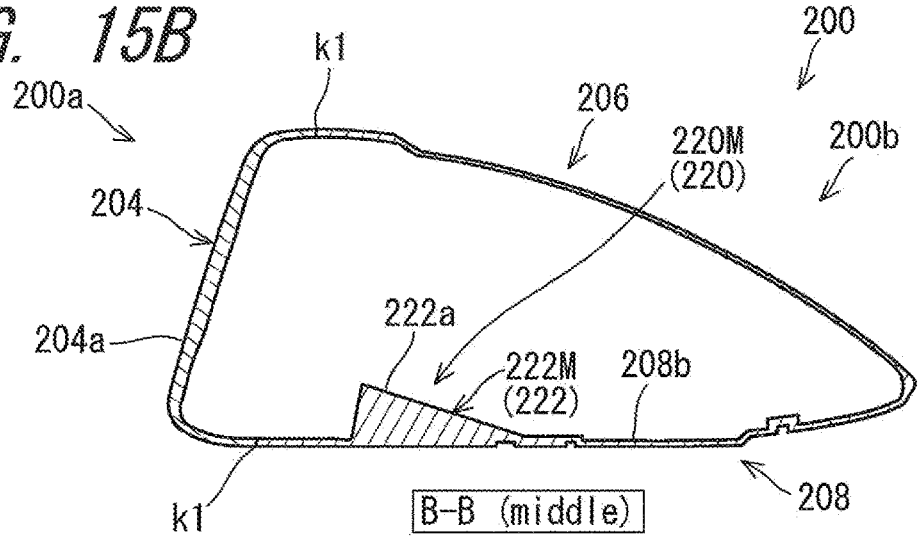
FIG. 15B is a cross-sectional view taken along line B-B in FIG. 12.
Figure 15C:
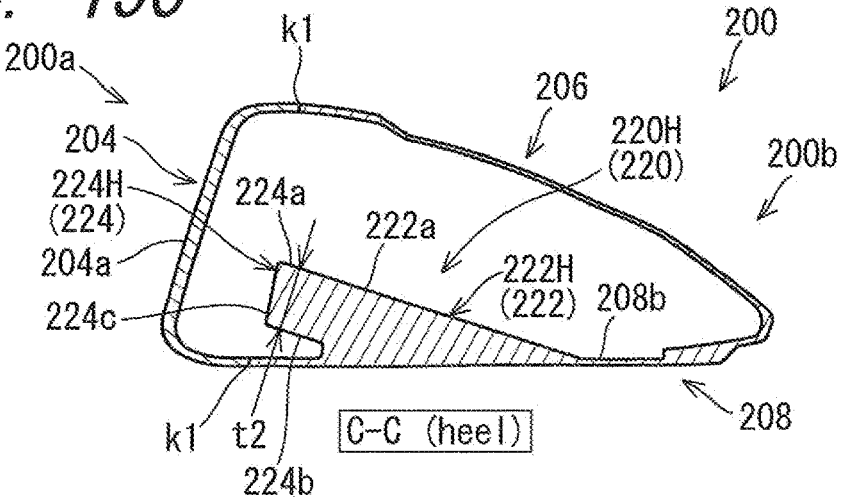
FIG. 15C is a cross-sectional view taken along line C-C in FIG. 12.

FIG. 12 is a plan view of a golf club head 200 according to a second embodiment. FIG. 13 is a perspective view of a body member 200*b* of the head 200. FIG. 14 is a front view of the body member 200*b*. FIG. 15A is a vertical cross-sectional view taken along line A-A in FIG. 12. FIG. 15B is a vertical cross-sectional view taken along line B-B in FIG. 12. FIG. 15C is a vertical cross-sectional view taken along line C-C in FIG. 12. In appearance, the head 200 is the same as the head 100.

The head 200 includes a face portion 204, a crown portion 206, a sole portion 208, and a hosel portion 210. The sole portion 208 includes an outer surface 208*a* and an inner surface 208*b*. The hosel portion 210 includes an exposed part 210*a* exposed to outside of the head 200, and an inner extending part 210*b* positioned inside the head 200. The hosel portion 210 also has a hosel hole 212. The face portion 204 includes a striking face 204*a*.

From the viewpoint of components, the head 200 includes a face member 200*a* and the body member 200*b*. The face member 200*a* is welded to the body member 200*b*. In FIG. 15A, FIG. 15B, and FIG. 15C, a boundary k1 between the face member 200*a* and the body member 200*b* is indicated.

The head 200 includes an internal weight portion 220. The body member 200*b* includes the internal weight portion 220. The internal weight portion 220 is provided on the inner side of the sole portion 208. The internal weight portion 220 is provided on the inner surface 208*b* of the sole portion 208.

The internal weight portion 220 is integrated with the sole portion 208. The internal weight portion 220 is formed integrally with the sole portion 208. The internal weight portion 220 is integrated with the body member 200*b*. An entirety of the body member 200*b* including the internal weight portion 220 is integrally formed as a single-piece member.

The internal weight portion 220 includes a base portion 222, and a protruding portion 224 that protrudes from the base portion 222 toward the face side. The base portion 222 is integrated with the inner surface 208*b* of the sole portion 208.

The protruding portion 224 includes an upper surface 224*a* and a lower surface 224*b*. The protruding portion 224 also includes a front end face 224*c*. The upper surface 224*a* is inclined such that it goes upward as its proximity to the face portion 204 increases. The lower surface 224*b* is inclined such that it goes upward as its proximity to the face portion 204 increases.

The base portion 222 includes an upper surface 222*a*. The upper surface 222*a* is inclined such that it goes upward as its proximity to the face portion 204 increases.

With reference to FIG. 15A, FIG. 15B, and FIG. 15C, the internal weight portion 220 includes a toe-side part 220T, a heel-side part 220H, and a middle part 220M.

The protruding portion 224 includes a toe protruding part 224T and a heel protruding part 224H. As described above, no middle protruding part is present. In the present embodiment, of the internal weight portion 220, a part that does not include the protruding portion 224 is defined as the middle part 220M, a part located on the toe side with respect to the middle part 220M is defined as the toe-side part 220T, and a part located on the heel side with respect to the middle part 220M is defined as the heel-side part 220H.

As well illustrated in FIG. 13, the upper surface 222*a* includes a toe-side step 226 and a heel-side step 228. A lower edge 226*a* of the toe-side step 226 can be a boundary between the toe-side part 220T and the middle part 220M. A lower edge 228*a* of the heel-side step 228 can be a boundary between the heel-side part 220H and the middle part 220M.

The toe protruding part 224T has a first thickness t1. The heel protruding part 224H has a second thickness t2. The head 200 the same as the head 100 except that the middle part 220M of the internal weight portion 220 does not include a protruding portion.

Figure 16:
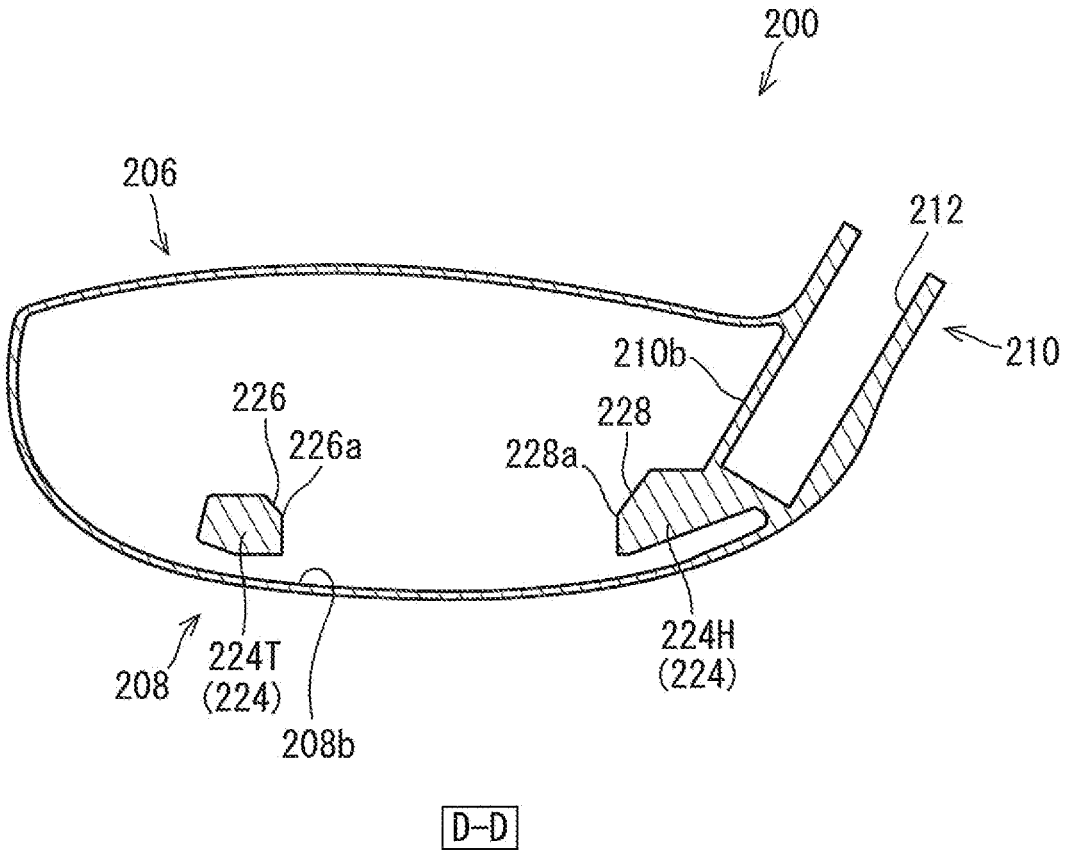
FIG. 16 is a cross-sectional view taken along line D-D in FIG. 12.
Figure 17:
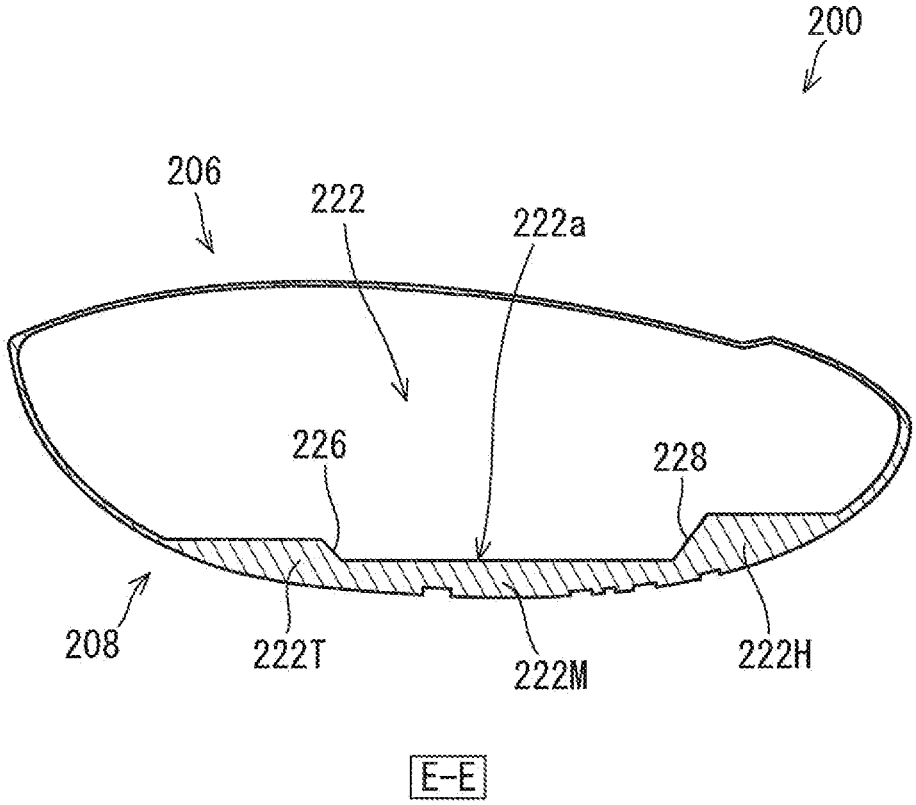
FIG. 17 is a cross-sectional view taken along line E-E in FIG. 12.

FIG. 16 is a cross-sectional view taken along line D-D in FIG. 12. FIG. 16 shows a cross section taken along the toe-heel direction at a position where the protruding portion 224 is present. FIG. 17 is a cross-sectional view taken along line E-E in FIG. 12. FIG. 17 shows a cross section taken along the toe-heel direction at a position where the base portion 222 is present. The base portion 222 includes a toe base part 222T, a heel base part 222H, and a middle base part 222M. As shown in FIG. 17, the base portion 222 is the same as the base portion 122 of the head 100. As shown in FIG. 16, however, a middle part is absent in the protruding portion 224, unlike the protruding portion 124 of the head 100.

Third Embodiment

Figure 18:
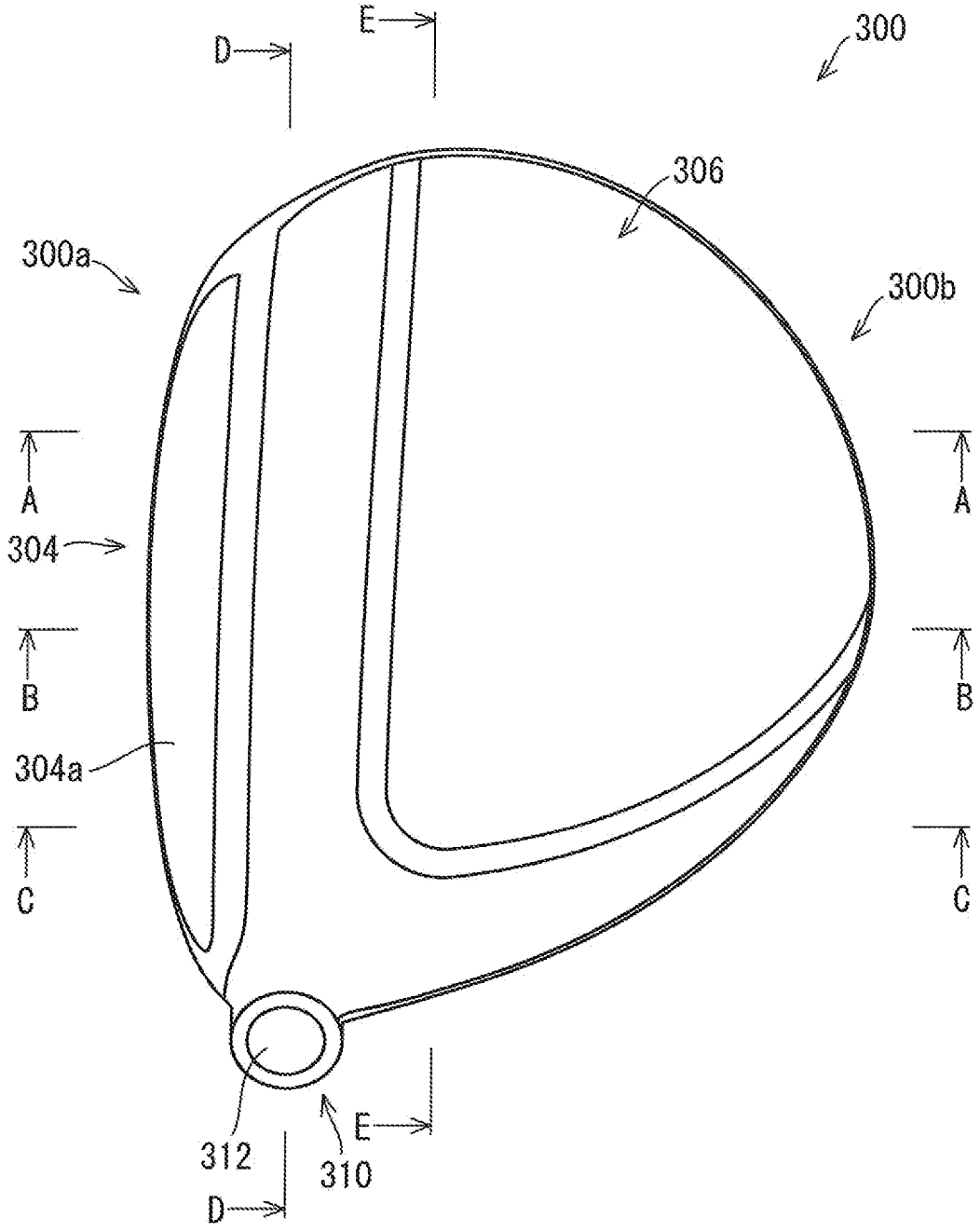
FIG. 18 is a plan view of a golf club head according to a third embodiment.
Figure 19:
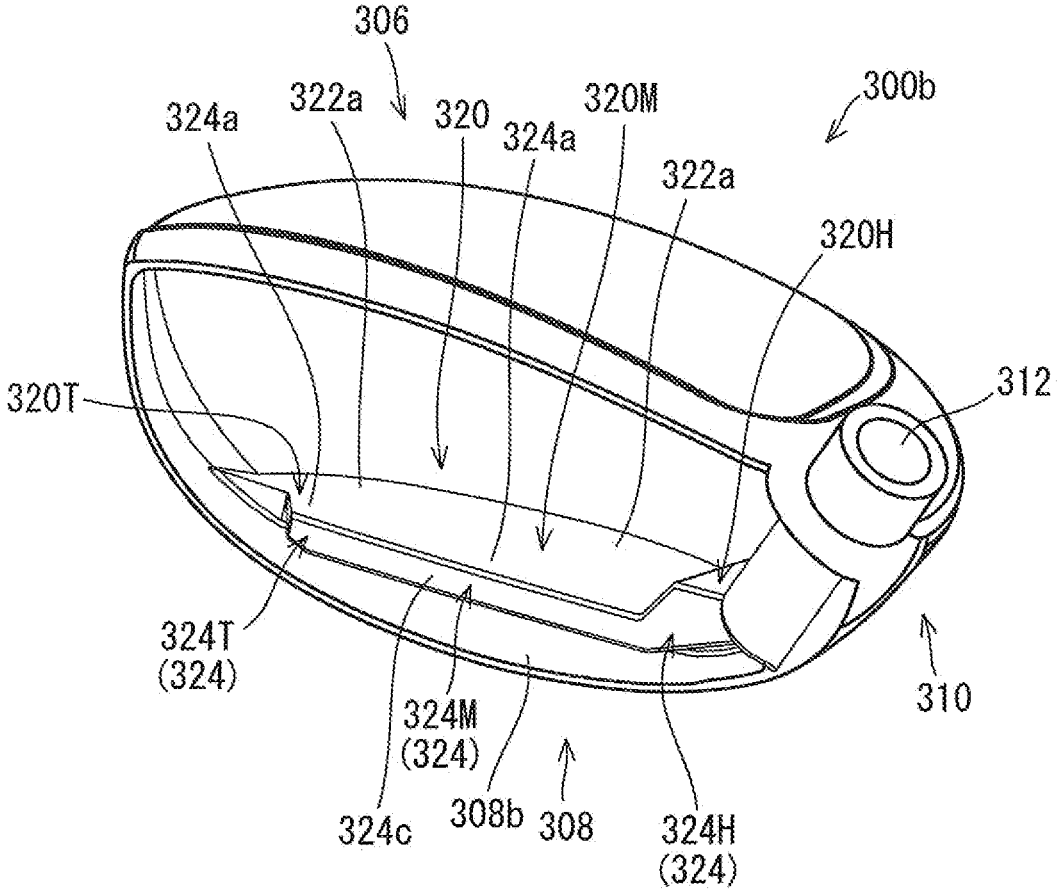
FIG. 19 is a perspective view of a body member of the head in FIG. 18.
Figure 20:
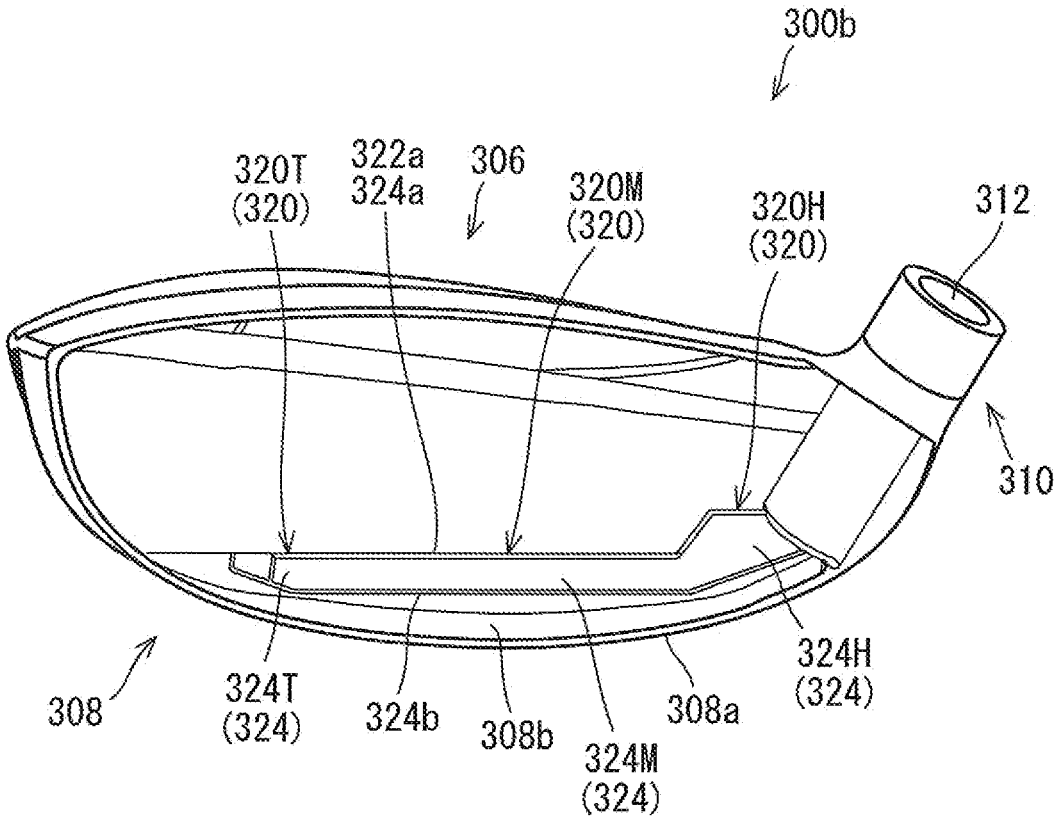
FIG. 20 is a front view of the body member in FIG. 19.
Figure 21A:
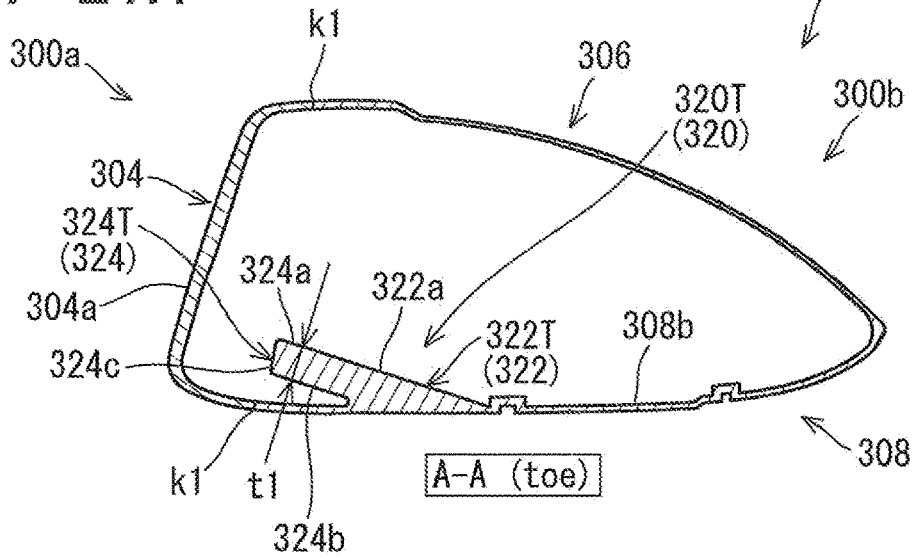
FIG. 21A is a cross-sectional view taken along line A-A in FIG. 18.
Figure 21B:
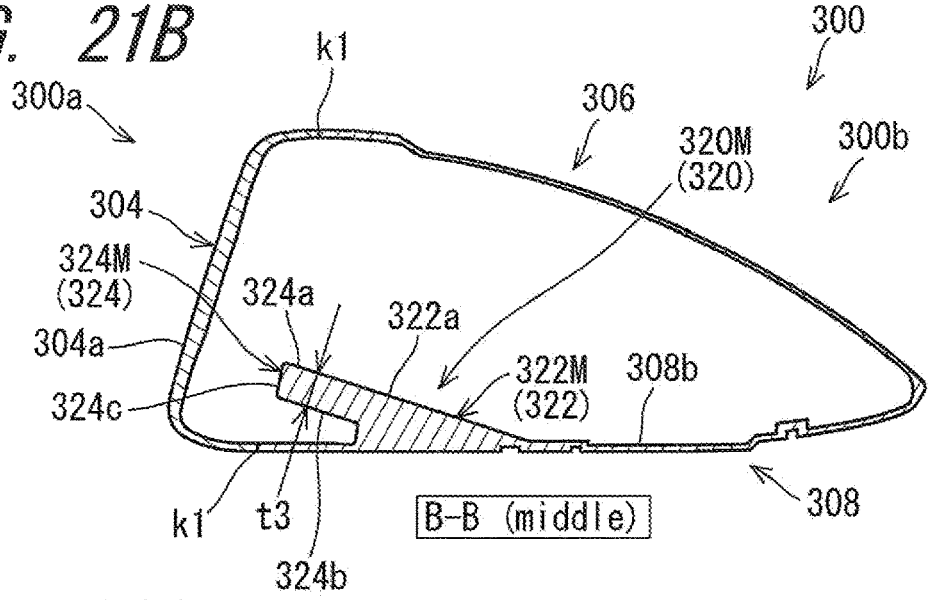
FIG. 21B is a cross-sectional view taken along line B-B in FIG. 18.
Figure 21C:
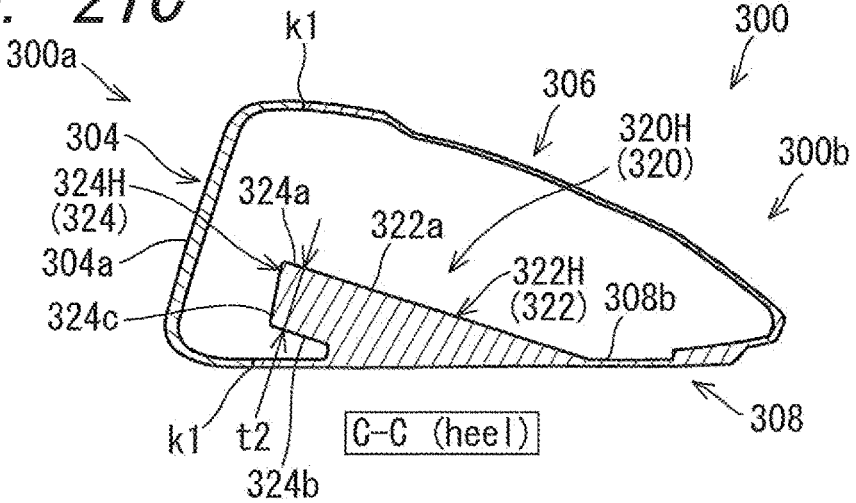
FIG. 21C is a cross-sectional view taken along line C-C in FIG. 18.

FIG. 18 is a plan view of a golf club head 300 according to a third embodiment. FIG. 19 is a perspective view of a body member 300*b* of the head 300. FIG. 20 is a front view of the body member 300*b*. FIG. 21A is a vertical cross-sectional view taken along line A-A in FIG. 18. FIG. 21B is a vertical cross-sectional view taken along line B-B in FIG. 18. FIG. 21C is a vertical cross-sectional view taken along line C-C in FIG. 18. In appearance, the head 300 is the same as the head 100.

The head 300 includes a face portion 304, a crown portion 306, a sole portion 308, and a hosel portion 310. The sole portion 308 includes an outer surface 308*a* and an inner surface 308*b*. The hosel portion 310 has a hosel hole 312. The face portion 304 includes a striking face 304*a*.

From the viewpoint of components, the head 300 includes a face member 300*a* and the body member 300*b*. The face member 300*a* is welded to the body member 300*b*. In FIG. 21A, FIG. 21B, and FIG. 21C, a boundary k1 between the face member 300*a* and the body member 300*b* is indicated.

The head 300 includes an internal weight portion 320. The body member 300*b* includes the internal weight portion 320. The internal weight portion 320 is provided on the inner side of the sole portion 308. The internal weight portion 320 is provided on the inner surface 308*b* of the sole portion 308.

The internal weight portion 320 includes a base portion 322, and a protruding portion 324 that protrudes from the base portion 322 toward the face side. The base portion 322 is integrated with the inner surface 308*b* of the sole portion 308.

The protruding portion 324 includes an upper surface 324*a* and a lower surface 324*b*. The protruding portion 324 also includes a front end face 324*c*. The upper surface 324*a* is inclined such that it goes upward as its proximity to the face portion 304 increases. The lower surface 324*b* is inclined such that it goes upward as its proximity to the face portion 304 increases.

The base portion 322 includes an upper surface 322*a*. The upper surface 322*a* is inclined such that it goes upward as its proximity to the face portion 304 increases.

With reference to FIG. 21A, FIG. 21B, and FIG. 21C, the internal weight portion 320 includes a toe-side part 320T, a heel-side part 320H, and a middle part 320M.

Figure 22:
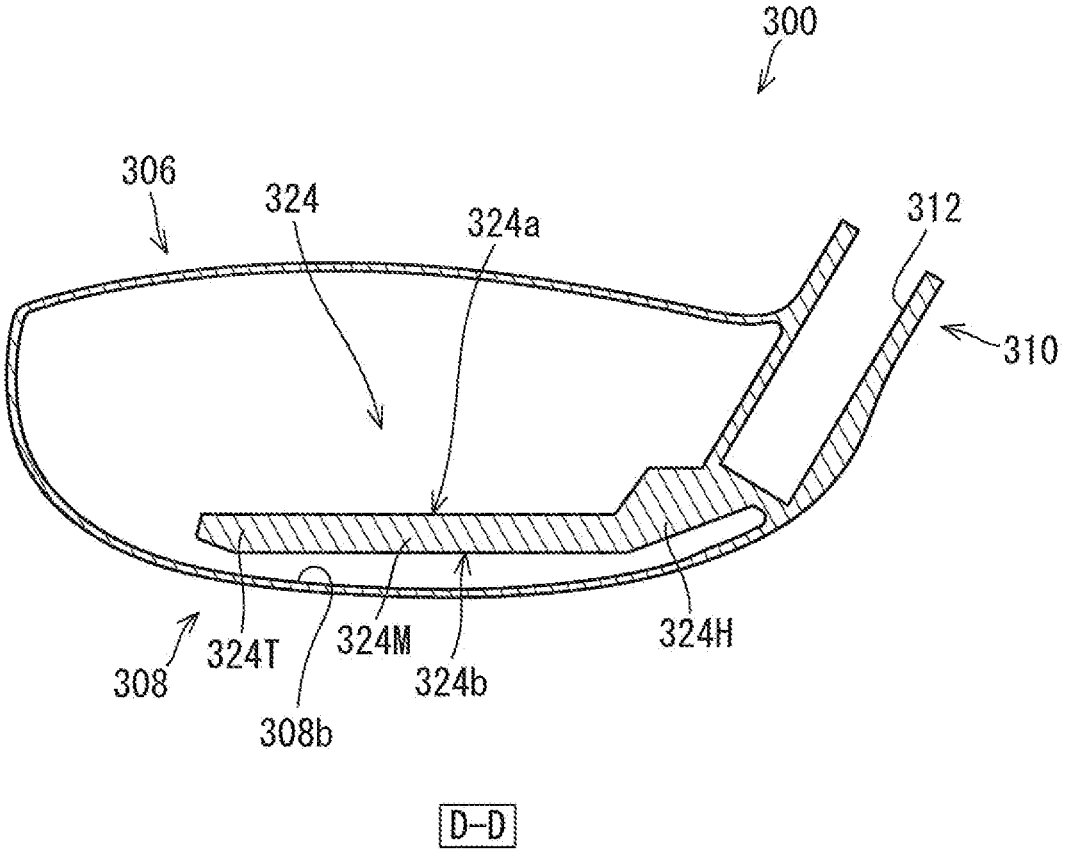
FIG. 22 is a cross-sectional view taken along line D-D in FIG. 18.
Figure 23:
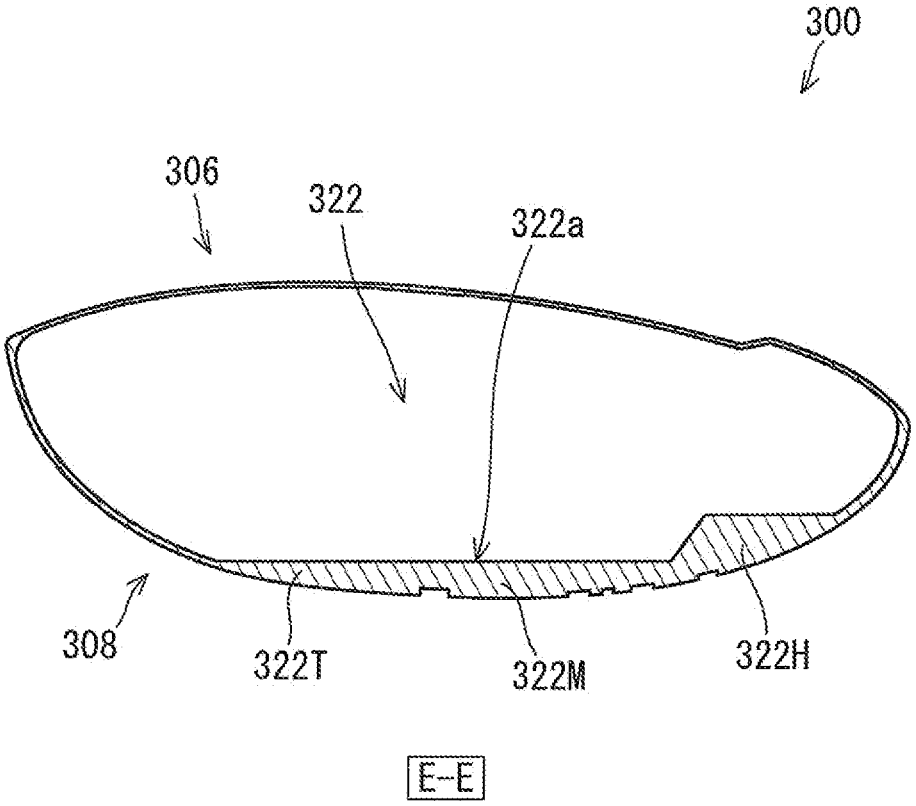
FIG. 23 is a cross-sectional view taken along line E-E in FIG. 18.

FIG. 22 is a cross-sectional view taken along line D-D in FIG. 18. FIG. 22 shows a cross section taken along the toe-heel direction at a position where the protruding portion 324 is present. FIG. 23 is a cross-sectional view taken along line E-E in FIG. 18. FIG. 23 shows a cross section taken along the toe-heel direction at a position where the base portion 322 is present. As shown in FIG. 22, the protruding portion 324 includes a toe protruding part 324T, a middle protruding part 324M, and a heel protruding part 324H. As shown in FIG. 23, the base portion 322 includes a toe base part 322T, a heel base part 322H, and a middle base part 322M. In the toe-side part 320T of the internal weight portion 320, not only the toe protruding part 324T but also the toe base part 322T is thin.

As shown in FIG. 21A, the toe protruding part 324T has a first thickness t1. As shown in FIG. 21C, the heel protruding part 324H has a second thickness t2. As shown in FIG. 21B, the middle protruding part 324M has a third thickness t3. The second thickness t2 is greater than the third thickness t3. On the other hand, the first thickness t1 is equal to the third thickness t3. The head 300 is the same as the head 100 except that the thickness t1 is equal to the thickness t3. In the head 300, a step that can be a boundary between the middle protruding part 324M and the toe protruding part 324T is not present on the upper surface 324*a*. In the internal weight portion 320, a predetermined position located on the toe side with respect to the face center Fc can be a boundary between the toe-side part 320T and the middle part 320M.

Fourth Embodiment

Figure 24:
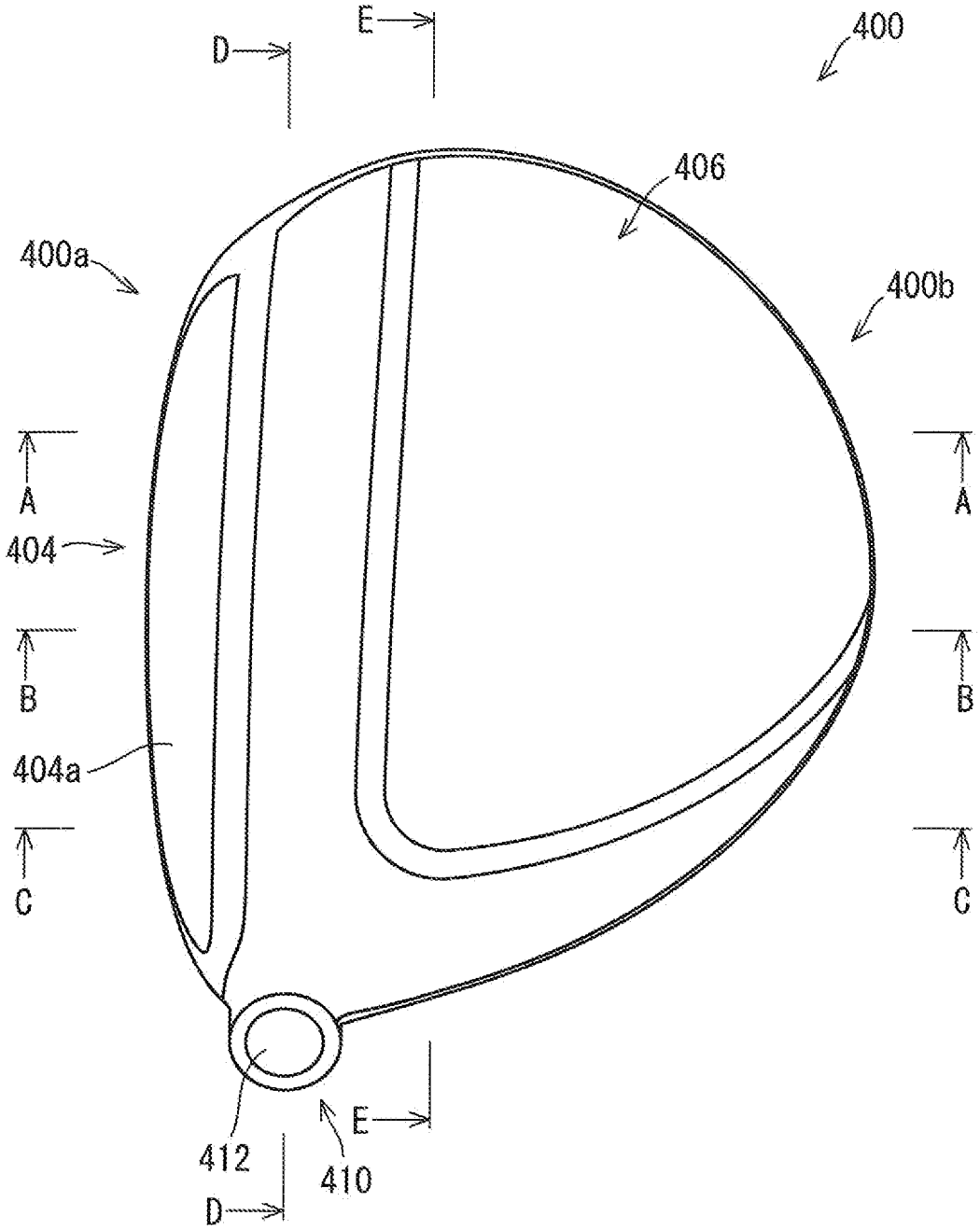
FIG. 24 is a plan view of a golf club head according to a fourth embodiment.
Figure 25:
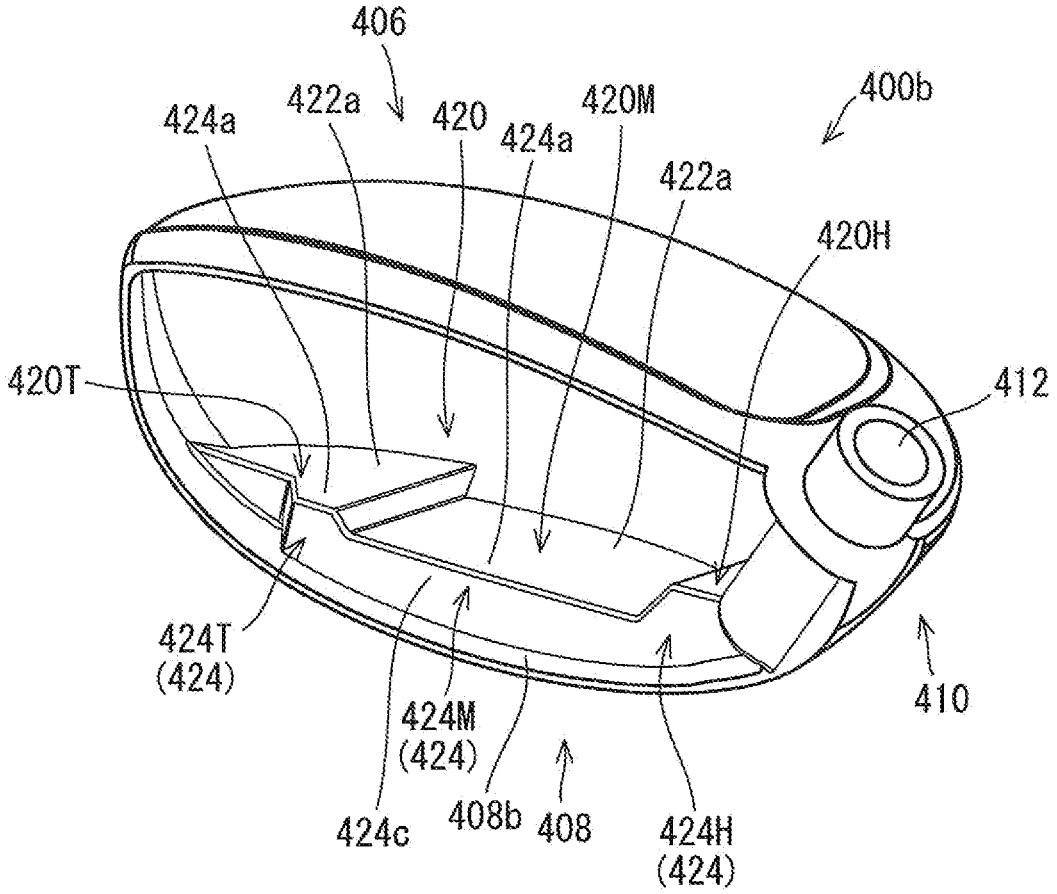
FIG. 25 is a perspective view of a body member of the head in FIG. 24.
Figure 26:
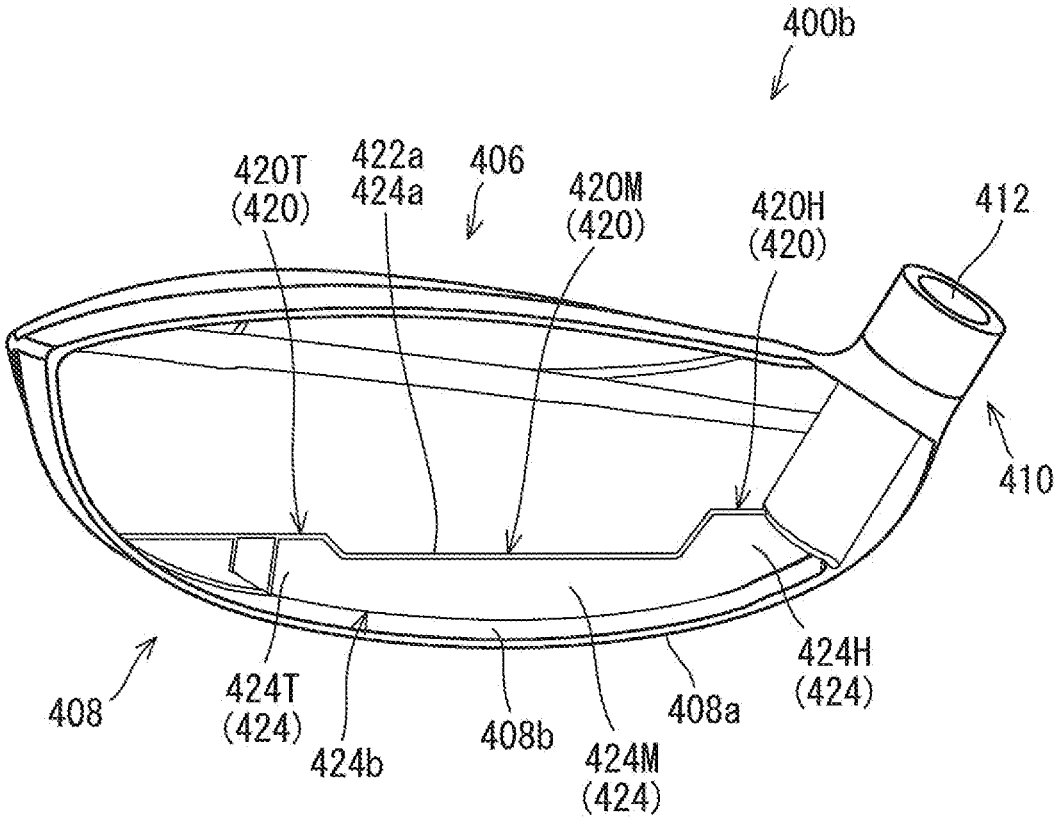
FIG. 26 is a front view of the body member in FIG. 25.
Figure 27A:
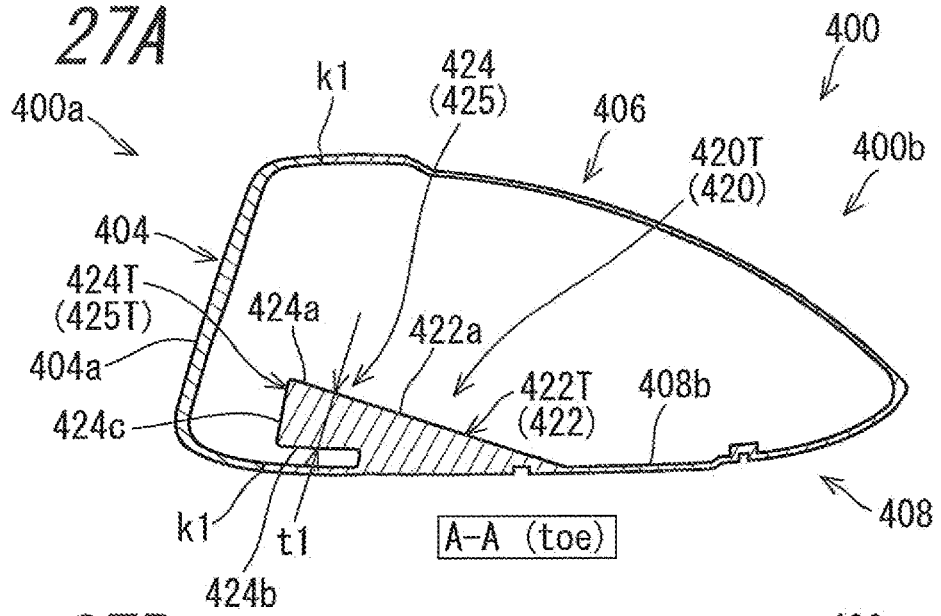
FIG. 27A is a cross-sectional view taken along line A-A in FIG. 24.
Figure 27B:
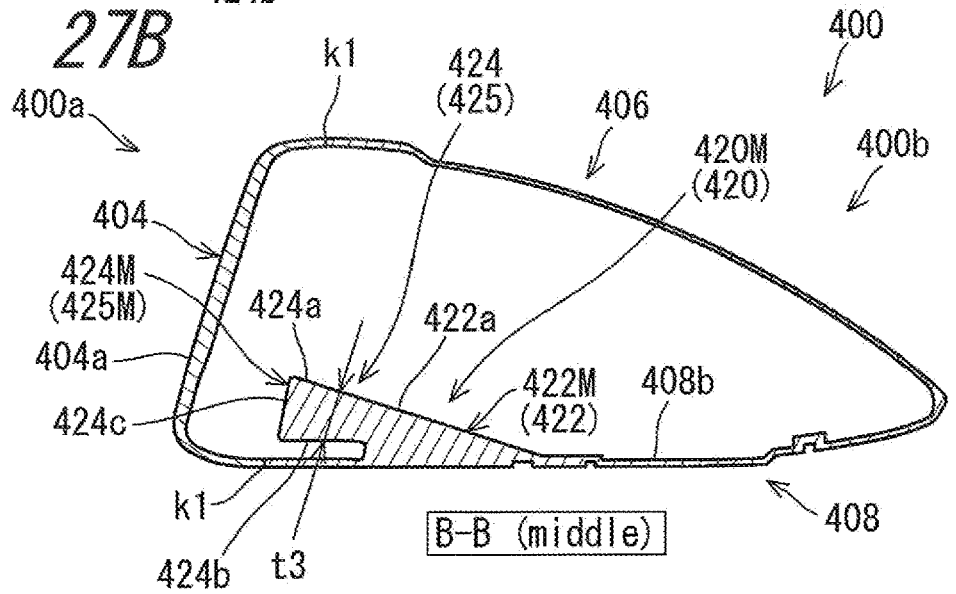
FIG. 27B is a cross-sectional view taken along line B-B in FIG. 24.
Figure 27C:
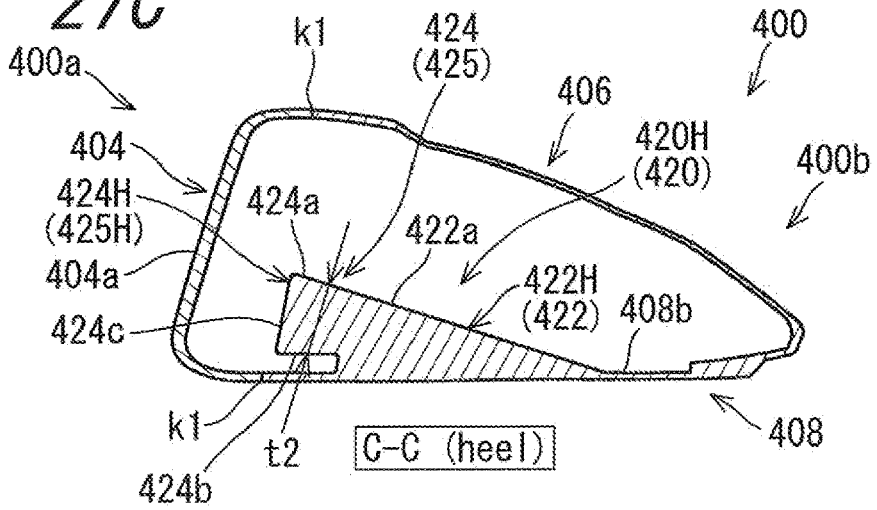
FIG. 27C is a cross-sectional view taken along line C-C in FIG. 24.

FIG. 24 is a plan view of a golf club head 400 according to a fourth embodiment. FIG. 25 is a perspective view of a body member 400*b* of the head 400. FIG. 26 is a front view of the body member 400*b*. FIG. 27A is a vertical cross-sectional view taken along line A-A in FIG. 24. FIG. 27B is a vertical cross-sectional view taken along line B-B in FIG. 24. FIG. 27C is a vertical cross-sectional view taken along line C-C in FIG. 24. In appearance, the head 400 is the same as the head 100.

The head 400 includes a face portion 404, a crown portion 406, a sole portion 408, and a hosel portion 410. The sole portion 408 includes an outer surface 408*a* and an inner surface 408*b*. The hosel portion 410 has a hosel hole 412. The face portion 404 includes a striking face 404*a*.

From the viewpoint of components, the head 400 includes a face member 400*a* and the body member 400*b*. The face member 400*a* is welded to the body member 400*b*. In FIG. 27A, FIG. 27B, and FIG. 27C, a boundary k1 between the face member 400*a* and the body member 400*b* is indicated.

The head 400 includes an internal weight portion 420. The body member 400*b* includes the internal weight portion 420. The internal weight portion 420 is provided on the inner side of the sole portion 408. The internal weight portion 420 is provided on the inner surface 408*b* of the sole portion 408.

The internal weight portion 420 includes a base portion 422, and a protruding portion 424 that protrudes from the base portion 422 toward the face side. The base portion 422 is integrated with the inner surface 408*b* of the sole portion 408.

The protruding portion 424 includes an upper surface 424*a* and a lower surface 424*b*. The protruding portion 424 also includes a front end face 424*c*. The upper surface 424*a* is inclined such that it goes upward as its proximity to the face portion 404 increases. In contrast, the lower surface 424*b* extends to be substantially parallel to the face-back direction. The term "substantially parallel" can mean that an angle of inclination with respect to the face-back direction is less than or equal to 10°.

The inner surface 408*b* of the sole portion 408 is substantially parallel to the lower surface 424*b*. The inner surface 408*b* and the lower surface 424*b* are opposed to each other such that no undercut is formed.

The base portion 422 includes an upper surface 422*a*. The upper surface 422*a* is inclined such that it goes upward as its proximity to the face portion 404 increases.

With reference to FIG. 27A, FIG. 27B, and FIG. 27C, the internal weight portion 420 includes a toe-side part 420T, a heel-side part 420H, and a middle part 420M.

Figure 28:
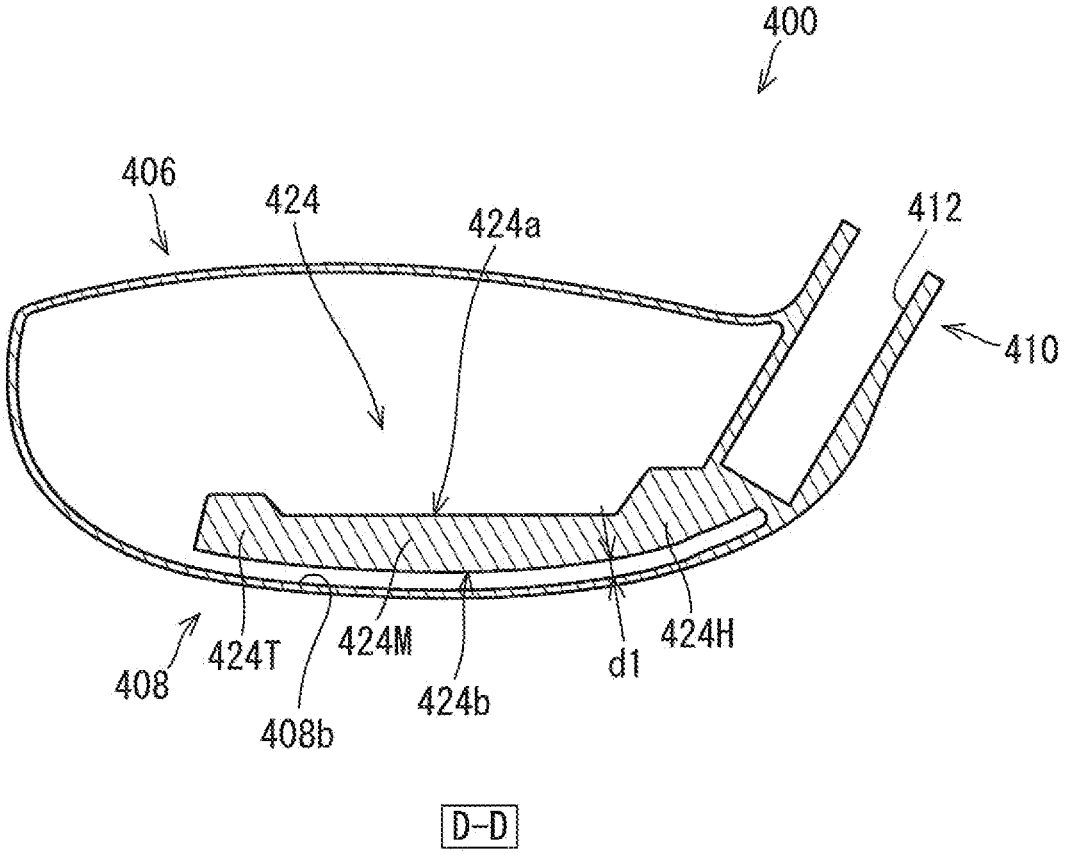
FIG. 28 is a cross-sectional view taken along line D-D in FIG. 24.
Figure 29:
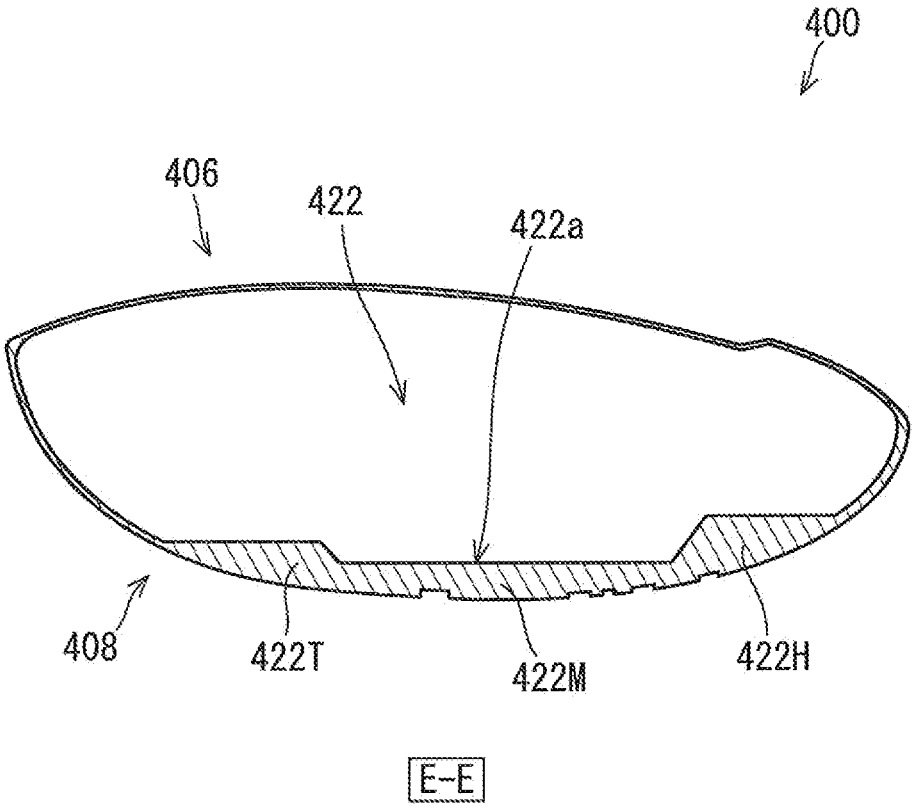
FIG. 29 is a cross-sectional view taken along line E-E in FIG. 24.

FIG. 28 is a cross-sectional view taken along line D-D in FIG. 24. FIG. 28 shows a cross section taken along the toe-heel direction at a position where the protruding portion 424 is present. FIG. 29 is a cross-sectional view taken along line E-E in FIG. 24. FIG. 29 shows a cross section taken along the toe-heel direction at a position where the base portion 422 is present. As shown in FIG. 28, the protruding portion 424 includes a toe protruding part 424T, a middle protruding part 424M, and a heel protruding part 424H. As shown in FIG. 29, the base portion 422 includes a toe base part 422T, a heel base part 422H, and a middle base part 422M.

As shown in FIG. 27A, the toe protruding part 424T has a first thickness t1. As shown in FIG. 27C, the heel protruding part 424H has a second thickness t2. As shown in FIG. 27B, the middle protruding part 424M has a third thickness t3. The toe protruding part 424T forms a thickness changing part 425T in which the first thickness t1 continuously increases as its proximity to the face portion 404 increases. The heel protruding part 424H forms a thickness changing part 425H in which the second thickness t2 continuously increases as its proximity to the face portion 404 increases. The middle protruding part 424M forms a thickness changing part 425M in which the third thickness t3 continuously increases as its proximity to the face portion 404 increases. The protruding portion 424 forms a thickness change portion 425 having a thickness that continuously increases as its proximity to the face portion 404 increases.

The second thickness t2 is greater than the third thickness t3. The first thickness t1 is greater than the third thickness t3. The second thickness t2 is greater than the first thickness t1. When each of the thickness t1, the thickness t2, and the thickness t3 varies, the thickness t1, the thickness t2, and the thickness t3 can be considered as respective average values.

The maximum value of the second thickness t2 is greater than the maximum value of the third thickness t3. The maximum value of the first thickness t1 is greater than the maximum value of the third thickness t3. The maximum value of the second thickness t2 is greater than the maximum value of the first thickness t1.

A double-pointed arrow dl in FIG. 28 indicates a distance between the lower surface 424*b* of the protruding portion 424 and the inner surface 408*b* of the sole portion 408. As described above, this distance dl is also referred to as an interspace distance.

As shown in FIG. 28, the lower surface 424*b* of the protruding portion 424 is formed so as to extend along the inner surface 408*b* of the sole portion 408, as viewed in the cross section taken along the toe-heel direction. The inner surface 408*b* of the sole portion 408 is curved so as to project downward as viewed in this cross section. The lower surface 424*b* is also curved so as to project downward as viewed in this cross section. As described above, the maximum value dlmax and the minimum value dlmin of the interspace distance dl are determined in this cross section. In the present embodiment, [(dlmax−dlmin)/dlmax] can be set to be less than or equal to 0.2, further set to be less than or equal to 0.15, or still further set to be less than or equal to 0.1. In addition, dlmax can be set to be less than or equal to 3.5 mm, further set to be less than or equal to 3 mm, or still further set to be less than or equal to 2.5 mm.

The first embodiment (head 100), the second embodiment (head 200), the third embodiment (head 300), and the fourth embodiment (head 400) described above can achieve the following advantageous effects. Note that when descriptions below are applicable to two or more of the embodiments and different reference symbols are used for a common portion (same kind of portion) in the embodiments, the reference symbols are omitted in the following descriptions.

In all the embodiments, the head (this head means the head 100, the head 200, the head 300 and the head 400 but a singular form, not plural form, is used for the sake of easy understanding) includes the internal weight portion disposed at a position located apart from the face portion. If the internal weight portion is disposed on the inner surface of the sole portion, the rigidity of the sole portion can be increased. However, the internal weight portion is disposed apart from the face portion, which can prevent the internal weight portion from increasing the rigidity of a region of the sole portion located near the face portion. For this reason, the region of the sole portion located near the face portion is easily bent at impact, which can improve the rebound performance. In addition, the presence of the internal weight portion lowers the position of the head center of gravity CG, which can improve the rebound performance in a shot at a lower hit point. The "lower hit point" means that a head strikes a ball at a hit point that is located in a lower region of its striking face. When a ball that is not teed up but placed directly on the ground is hit, the hit point tends to be a lower hit point. The improvement of rebound performance in a shot at a lower hit point is advantageous for striking a ball placed directly on the ground.

The protruding portion which extends toward the face side can allow the head center of gravity CG to be located at a front-side position (face-side position) of the head. This allows the sweet spot SS to be located at a lower position of the striking face, thereby improving the rebound performance in a shot at a lower hit point.

Note that the sweet spot SS means an intersection point at which a line that is normal to the striking face and passes through the head center of gravity CG intersects the striking face (see FIG. 7). Since the golf club head has a loft angle, when the head center of gravity CG is located at a front-side position of the head, the sweet spot SS tends to be located at a lower-side position of the face. This tendency is stronger as the loft angle is greater.

In the head 100, the head 300, and the head 400, the thickness of the toe-side part of the protruding portion and/or the thickness of the heel-side part of the protruding portion are/is greater than the thickness of the middle part of the protruding portion. For this reason, the weight of the protruding portion is largely allocated to the toe side and/or the heel side, which can increase the lateral moment of inertia of the head. This can make it possible to expand the high rebound performance area on the face while improving the directional stability of hit balls. The "lateral moment of inertia" means a moment of inertia about an axis line that passes through the head center of gravity CG and extends in the up-down direction.

In the head 100 and the head 400, the thickness of the toe-side part of the protruding portion and the thickness of the heel-side part of the protruding portion are greater than the thickness of the middle part of the protruding portion. For this reason, the weight of the protruding portion is largely allocated to the toe side and the heel side, which can increase the lateral moment of inertia of the head.

In the head 200, the protruding portion 224 includes the toe-side part (toe protruding part 224T) and the heel-side part (heel protruding part 224H), but a middle part in the toe-heel direction of the protruding portion 224 is absent. In other words, the toe-side part 220T and the heel-side part 220H of the internal weight portion 220 include respective protruding parts, but the middle part 220M of the internal weight portion 220 does not include a protruding part. For this reason, the weight of the protruding portion is largely allocated to the toe side and the heel side, which can increase the lateral moment of inertia of the head. This can make it possible to expand the high rebound performance area on the face while improving the directional stability of hit balls. In addition, the middle part 220M still includes the middle part of the base portion (middle base part 222M), which can allow the internal weight portion 220 to have a greater weight.

In all the embodiments, the thickness of the toe-side part of the base portion and/or the thickness of the heel-side part of the base portion is greater than the thickness of the middle part of the base portion. The weight of the base portion is therefore largely allocated to the toe side and/or the heel side. The synergistic effect of the protruding portion and the base portion can make it possible to further increase the lateral moment of inertia of the head. This therefore can make it possible to further expand the high rebound performance area on the face while improving the directional stability of hit balls.

In the head 100, the head 300, and the head 400, the upper surface of the middle part of the protruding portion (the middle protruding part) is positioned on the lower side with respect to the upper surface of the toe-side part of the protruding portion (the toe protruding part) and/or the upper surface of the heel-side part of the protruding portion (the heel protruding part). In the head 100 and the head 400, the upper surface of the middle part of the protruding portion (the middle protruding part) is positioned on the lower side with respect to the upper surface of the toe-side part of the protruding portion (the toe protruding part) and the upper surface of the heel-side part of the protruding portion (the heel protruding part). This can lower the position of the head center of gravity. In addition, this shape of the upper surface of the protruding portion conforms to the shape of the sole portion that is curved so as to be lower in the middle in the cross section taken along the toe-heel direction, and is effective for lowering the position of the head center of gravity CG while allowing the protruding portion to be disposed on the inner side of the sole portion.

In all the embodiments, the upper surface of the middle part of the base portion (the middle base part) is positioned on the lower side with respect to the upper surface of the toe-side part of the base portion (the toe base part) and/or the upper surface of the heel-side part of the base portion (the heel base part). In the head 100, the head 200, and the head 400, the upper surface of the middle part of the base portion (the middle base part) is positioned on the lower side with respect to the upper surface of the toe-side part of the base portion (the toe base part) and the upper surface of the heel-side part of the base portion (the heel base part). This can lower the position of the head center of gravity. In addition, this shape of the upper surface of the base portion conforms to the shape of the sole portion that is curved so as to be lower in the middle in the cross section taken along the toe-heel direction, and is effective for lowering the position of the head center of gravity CG while allowing the base portion to be disposed on the inner side of the sole portion. The shape of the upper surface of the base portion, together with the shape of the upper surface of the protruding portion described above, can lower the position of the head center of gravity CG.

In all the embodiments, the lower surface of the protruding portion is formed so as to extend along the inner surface of the sole portion, as viewed in the cross section taken along the toe-heel direction (see FIG. 9, FIG. 16, FIG. 22, and FIG. 28). This shape of the lower surface of the protruding portion contributes to allowing the protruding portion to extend in the lower part of the head while locating the protruding portion apart from the sole portion, thereby obtaining an enough thickness of the protruding portion. When the sole portion has a shape that is curved so as to be lower in the middle in the cross section taken along the toe-heel direction, this shape of the lower surface of the protruding portion is effective for lowering the position of the head center of gravity CG while conforming to the shape of the sole portion.

In all the embodiments, the protruding portion is positioned on the face side with respect to the head center of gravity CG. This can make it possible to locate the head center of gravity CG at a front-side position of the head, which can lower the position of the sweet spot SS. In addition, the protruding portion is located apart from the sole portion, which can make it possible to avoid an increase in the rigidity of a region of the sole portion located near the face.

In all the embodiments, the lower surface of the protruding portion and the inner surface of the sole portion are opposed to each other such that no undercut is formed (see FIG. 6, FIG. 15, FIG. 21, and FIG. 27). In addition, the sole portion includes the thickness transition part located in the vicinity of a face-side part of the internal weight portion, and the lower surface of the protruding portion and the upper surface of the thickness transition part are opposed to each other such that no undercut is formed. This makes it easier to remove a mold when the internal weight portion and the sole portion are integrally formed as a single-piece member.

In the head 100, the head 200, and the head 300, the upper surface of the protruding portion extends in parallel to the lower surface of the protruding portion. This configuration is effective for allocating the weight of the protruding portion to the front side and the lower side, and is helpful in lowering the position of the sweet spot SS.

In the modification example shown in FIG. 11 (head 150), the thickness of the protruding portion 124 decreases as its proximity to the face portion 104 increases. This configuration is effective for allocating the weight of the protruding portion 124 to the lower side, and is helpful in lowering the position of the sweet spot SS. In addition, since a draft angle is formed by the shape of the protruding portion 124, it is further easier to remove a mold when the sole portion 108 and the internal weight portion 120 are integrally formed as a single-piece member.

A double-pointed arrow W3 in FIG. 8 indicates a distance between the leading edge Le and the first contact point P1. This distance is measured in the face-back direction. The leading edge Le can be defined as the frontmost point (face-most point) of the head in the vertical cross section.

With a view to locating the head center of gravity CG closer to the face and lowering the position of the sweet spot SS, the distance W3 is preferably less than or equal to 25 mm, more preferably less than or equal to 24 mm, and still more preferably less than or equal to 23 mm. With a view to obtaining a larger bending in a region of the sole portion near the face, the distance W3 is preferably greater than or equal to 10 mm, more preferably greater than or equal to 12 mm, and still more preferably greater than or equal to 14 mm.

As shown in FIG. 8, the wall thickness s1 at the first contact point P1 (the first thin part 108*d*) is smaller than the wall thickness of a part of the sole portion located on the front side (face side) with respect to the first contact point P1 (the sole front part 108*c*). This first thin part 108*d* can be a starting point of deformation of the sole portion 108 at impact. When the starting point of the deformation is located on the back side and the distance between the starting point of the deformation and the face portion 104 is increased, the deformation (or deflection) of the face portion 104 becomes larger. This can improve the rebound performance. With a view to increasing the distance between the first thin part 108*d* and the face portion 104 to enhance the rebound performance, the distance W3 is preferably greater than or equal to 10 mm, more preferably greater than or equal to 12 mm, and still more preferably greater than or equal to 14 mm.

From the viewpoint of the rebound performance, the wall thickness s1 is preferably less than or equal to 1.2 mm, more preferably less than or equal to 1.1 mm, and still more preferably less than or equal to 1.0 mm. From the viewpoint of the strength of the sole portion, the wall thickness s1 is preferably greater than or equal to 0.5 mm, more preferably greater than or equal to 0.6 mm, and still more preferably greater than or equal to 0.7 mm.

A double-pointed arrow W4 in FIG. 1 indicates the gravity center depth. The gravity center depth W4 means a distance between the shaft axis line Z and the head center of gravity CG. The gravity center depth W4 is measured in the face-back direction.

With a view to lowering the position of the sweet spot SS, the gravity center depth W4 is preferably less than or equal to 15 mm, more preferably less than or equal to 14.5 mm, and still more preferably less than or equal to 14 mm. With a view to obtaining a larger bending in a region of the sole portion near the face, it is not preferable that the distance W3 is excessively small. From this viewpoint, the gravity center depth W4 is preferably greater than or equal to 11 mm, more preferably greater than or equal to 11.5 mm, and still more preferably greater than or equal to 12 mm.

A double-pointed arrow H1 in FIG. 7 indicates a height of the head center of gravity CG. The height H1 is a height from the ground plane GP when the head is in the reference state. The height H1 is measured in the up-down direction.

With a view to lowering the position of the sweet spot SS, the height H1 is preferably less than or equal to 15 mm, more preferably less than or equal to 14.5 mm, and still more preferably less than or equal to 14 mm. Considering the length of the hosel portion 110 and the height of the head, the height H1 is preferably greater than or equal to 12 mm, more preferably greater than or equal to 12.5 mm, and still more preferably greater than or equal to 13 mm.

A double-pointed arrow H2 in FIG. 7 indicates a height of the sweet spot SS. The height H2 is a height from the ground plane GP when the head is in the reference state. The height H2 is measured in the up-down direction.

With a view to enhancing the rebound performance in striking a ball placed directly on the ground, the height H2 is preferably less than or equal to 23 mm, more preferably less than or equal to 22.5 mm, and still more preferably less than or equal to 22 mm. Considering the lower limit of the height H1 and the loft angle, the height H2 is preferably greater than or equal to 18.5 mm, more preferably greater than or equal to 19 mm, and still more preferably greater than or equal to 19.5 mm.

A reference symbol PL1 in FIG. 1 indicates a plane that divides the head 100 into two equal widths in the face-back direction. The plane PL1 is a plane perpendicular to the ground plane GP when the head is in the reference state. The plane PL1 is parallel to the toe-heel direction. The plane PL1 is perpendicular to the face-back direction.

The head 100 is divided by the plane PL1 into a face-side part with respect to the plane PL1, and a back-side part the with respect to the plane PL1. With a view to locating the head center of gravity CG closer to the face, a ratio of the weight of the face-side part with respect to the plane PL1 to the weight of the entire head is preferably greater than or equal to 63%, more preferably greater than or equal to 64%, and still more preferably greater than or equal to 65%. Considering the width of the head in the face-back direction, this ratio is preferably less than or equal to 90%, more preferably less than or equal to 89%, and still more preferably less than or equal to 88%.

A fairway wood type head and a hybrid type head have a greater loft angle as compared with a driver head. In these heads, accordingly, a decrease in the gravity center depth W4 makes the sweet spot SS lower by a greater degree. In addition, these heads have many opportunities to strike a ball that is placed directly on the ground, not a ball that is teed up. Accordingly, the above-described effect of decreasing the height H2 of the sweet spot SS is particularly effective for the fairway wood type head and the hybrid type head. From this viewpoint, a fairway wood type head and a hybrid type head are preferred as the head.

As described above, as the loft angle is greater, a decrease in the gravity center depth W4 makes the sweet spot SS lower by a greater degree. From this viewpoint, the loft angle is preferably greater than or equal to 13°, more preferably greater than or equal to 15°, and still more preferably greater than or equal to 17°. Considering the specifications of a fairway wood type head and a hybrid type head, the loft angle is preferably less than or equal to 35°, more preferably less than or equal to 33°, and still more preferably less than or equal to 31°. This loft angle is a real loft angle.

From the viewpoint that a fairway wood type head and a hybrid type head are preferred, the head volume is preferably less than or equal to 300 $cm^3$, more preferably less than or equal to 250 $cm^3$, and still more preferably less than or equal to 200 $cm^3$. From the same viewpoint, the head volume is preferably greater than or equal to 90 $cm^3$, more preferably greater than or equal to 100 $cm^3$, and still more preferably greater than or equal to 110 $cm^3$.

As described above, in all the embodiments, the weight of the protruding portion is largely allocated to the toe side and/or the heel side, and this can increase the lateral moment of inertia of the head. From this viewpoint, the lateral moment of inertia of the head is preferably greater than or equal to 2000 $g \cdot cm^2$, more preferably greater than or equal to 2050 $g \cdot cm^2$, and still more preferably greater than or equal to 2100 $g \cdot cm^2$. Considering the head volume of a fairway wood type head and a hybrid type head, the lateral moment of inertia of the head is preferably less than or equal to 3000 $g \cdot cm^2$, more preferably less than or equal to 2950 $g \cdot cm^2$, and still more preferably less than or equal to 2900 $g \cdot cm^2$.

Regarding the above-described embodiments, the following clauses are disclosed.

[Clause 1]

A golf club head comprising:

a face portion;

a sole portion; and an internal weight portion that is provided on an inner surface of the sole portion and is located apart from the face portion, wherein the internal weight portion includes a base portion, and a protruding portion that protrudes from the base portion toward a face side and is located apart from the inner surface of the sole portion, the protruding portion is positioned on the face side with respect to a center of gravity of the golf club head, and a thickness of a toe-side part of the protruding portion and/or a thickness of a heel-side part of the protruding portion is greater than a thickness of a middle part of the protruding portion, or a middle part of the protruding portion in a toe-heel direction is absent.

[Clause 2]

The golf club head according to clause 1, wherein a thickness of a toe-side part of the protruding portion and/or a thickness of a heel-side part of the protruding portion is greater than a thickness of a middle part of the protruding portion.

[Clause 3]

The golf club head according to clause 2, wherein an upper surface of the middle part of the protruding portion is positioned on a lower side with respect to an upper surface of the toe-side part and/or an upper surface of the heel-side part.

[Clause 4]

The golf club head according to clause 2 or 3, wherein a lower surface of the protruding portion is formed so as to extend along the inner surface of the sole portion, as viewed in a cross section taken along the toe-heel direction.

[Clause 5]

The golf club head according to any one of clauses 1 to 4, wherein a lower surface of the protruding portion and the inner surface of the sole portion are opposed to each other such that no undercut is formed.

[Clause 6]

The golf club head according to any one of clauses 1 to 5, wherein when a contact point on the face side between the internal weight portion and the inner surface of the sole portion is defined as a first contact point, and a wall thickness of the sole portion at the first contact point is denoted by s1, then the wall thickness s1 is smaller than a wall thickness of a sole front part that is positioned on the face side with respect to the first contact point, and thus a first thin part is formed at a position of the first contact point.

[Clause 7]

The golf club head according to clause 6, wherein the sole portion includes a thickness transition part in vicinity of the first contact point, the thickness transition part having a wall thickness that continuously decreases toward the first contact point.

[Clause 8]

The golf club head according to clause 7, wherein a lower surface of the protruding portion and an upper surface of the thickness transition part are opposed to each other such that no undercut is formed.

LIST OF REFERENCE SYMBOLS

100, 200, 300, 400 Golf club head
100*b*, 200*b*, 300*b*, 400*b* Body member
104, 204, 304, 404 Face portion
108, 208, 308, 408 Sole portion
108*b*, 208*b* 308*b*, 408*b* Inner surface of sole portion
108*c* Sole front part
108*d* First thin part
108*e* Thickness transition part
120, 220, 320, 420 Internal weight portion

120T, 220T, 320T, 420T Toe-side part of internal weight portion

120M, 220M, 320M, 420M Middle part of internal weight portion

120H, 220H, 320H, 420H Heel-side part of internal weight portion

122, 222, 322, 422 Base portion

122*a*, 222*a*, 322*a*, 422*a* Upper surface of base portion

122T, 222T, 322T, 422T Toe base part (Toe-side part of base portion)

122M, 222M, 322M, 422M Middle base part (Middle part of base portion)

122H, 222H, 322H, 422H Heel base part (Heel-side part of base portion)

124, 224, 324, 424 Protruding portion

124*a*, 224*a*, 324*a*, 424*a* Upper surface of protruding portion

124*b*, 224*b*, 324*b*, 424*b* Lower surface of protruding portion

124T, 224T, 324T, 424T Toe protruding part (Toe-side part of protruding portion)

124M, 324M, 424M Middle protruding part (Middle part of protruding portion)

124H, 224H, 324H, 424H Heel protruding part (Heel-side part of protruding portion)

P1 First contact point

CG Head center of gravity

Fc Face center

SS Sweet spot

Le Leading edge

The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising", "having", "including", and "containing" are to be construed as open-ended terms (i.e., meaning "including, but not limited to,") unless otherwise noted.

What is claimed is:

1. A golf club head comprising:

a face portion;

a sole portion;

a hosel portion; and an internal weight portion that is provided on an inner surface of the sole portion and is located apart from the face portion, wherein the internal weight portion includes a base portion attached to the inner surface of the sole portion, and a protruding portion that protrudes from the base portion toward a face side and is located apart from the inner surface of the sole portion, the base portion and the protruding portion extending continuously from a heel portion to a toe portion of the golf club head, the protruding portion is positioned on the face side with respect to a center of gravity of the golf club head, a thickness of a toe-side part of the protruding portion and/or a thickness of a heel-side part of the protruding portion is greater than a thickness of a middle part of the protruding portion, and the hosel portion includes an inner extending part disposed inside the golf club head, and the protruding portion includes a heel protruding part which is directly connected to the inner extending part of the hosel portion.

2. The golf club head according to claim 1, wherein an upper surface of the middle part of the protruding portion is positioned on a lower side with respect to an upper surface of the toe-side part and/or an upper surface of the heel-side part.

3. The golf club head according to claim 1, wherein a lower surface of the protruding portion is formed so as to extend along the inner surface of the sole portion, as viewed in a cross section taken along the toe-heel direction.

4. The golf club head according to claim 1, wherein a lower surface of the protruding portion and the inner surface of the sole portion are opposed to each other such that no undercut is formed.

5. The golf club head according to claim 1, wherein when a contact point on the face side between the internal weight portion and the inner surface of the sole portion is defined as a first contact point, and a wall thickness of the sole portion at the first contact point is denoted by s1, then the wall thickness s1 is smaller than a wall thickness of a sole front part that is positioned on the face side with respect to the first contact point, and thus a first thin part is formed at a position of the first contact point.

6. The golf club head according to claim 5, wherein the sole portion includes a thickness transition part in vicinity of the first contact point, the thickness transition part having a wall thickness that continuously decreases toward the first contact point.

7. The golf club head according to claim 6, wherein a lower surface of the protruding portion and an upper surface of the thickness transition part are opposed to each other such that no undercut is formed.

* * * * *